US009475337B2

(12) United States Patent
Riegler et al.

(10) Patent No.: US 9,475,337 B2
(45) Date of Patent: Oct. 25, 2016

(54) EMBOSSING STAMP AND DIE PLATE HOLDER FOR THE EMBOSSING STAMP

(71) Applicant: Trodat GmbH, Wels (AT)

(72) Inventors: Konrad Riegler, Eberstalzell (AT); Helmut Lindner, Peuerbach (AT)

(73) Assignee: Trodat GmbH (AT)

( * ) Notice: Subject to any disclaimer, the term of this patent is extended or adjusted under 35 U.S.C. 154(b) by 0 days.

(21) Appl. No.: 14/712,402

(22) Filed: May 14, 2015

(65) Prior Publication Data

US 2015/0246574 A1 Sep. 3, 2015

Related U.S. Application Data

(62) Division of application No. 14/258,682, filed on Apr. 22, 2014.

(30) Foreign Application Priority Data

Apr. 23, 2013 (AT) ..... 341/2013

(51) Int. Cl.
*B44B 5/02* (2006.01)
*B44B 5/00* (2006.01)
*B41K 3/36* (2006.01)

(52) U.S. Cl.
CPC ..... *B44B 5/0085* (2013.01); *B44B 5/0023* (2013.01); *B44B 5/0052* (2013.01); *B41K 3/36* (2013.01); *B44B 5/02* (2013.01)

(58) Field of Classification Search
None
See application file for complete search history.

(56) References Cited

U.S. PATENT DOCUMENTS

| | | | | | |
|---|---|---|---|---|---|
| 758,491 | A | * | 4/1904 | Woodman | 101/31.1 |
| 1,209,458 | A | * | 12/1916 | Leve | 101/31.1 |
| 1,471,687 | A | | 10/1923 | Eyman | |
| 1,489,097 | A | * | 4/1924 | Nichols | 83/145 |
| 1,619,959 | A | | 3/1927 | Sasseman | |
| 1,646,612 | A | | 10/1927 | Corey | |
| 2,187,773 | A | | 1/1940 | Eyman | |
| 2,906,197 | A | | 9/1959 | Priesmeyer | |
| 2,937,590 | A | * | 5/1960 | Priesmeyer | 101/31.1 |
| 2,948,214 | A | * | 8/1960 | Lotsch | 101/31.1 |
| 2,998,766 | A | * | 9/1961 | Priesmeyer | 101/31.1 |
| 3,554,122 | A | | 1/1971 | Priesmeyer et al. | |
| 4,204,468 | A | | 5/1980 | Harrison | |
| 4,574,693 | A | | 3/1986 | Fink et al. | |
| 5,054,389 | A | * | 10/1991 | Kuhlman et al. | 101/28 |
| 5,067,242 | A | * | 11/1991 | Singer | 30/364 |
| 5,722,319 | A | * | 3/1998 | Hirano | 101/23 |
| 5,819,647 | A | | 10/1998 | Balosh | |

(Continued)

FOREIGN PATENT DOCUMENTS

| | | | |
|---|---|---|---|
| BR | 8404986 | A | 5/1986 |
| DE | 202011100743 | U1 | 9/2011 |

*Primary Examiner* — Jill Culler
(74) *Attorney, Agent, or Firm* — Lerner, David, Littenberg, Krumholz & Mentlik, LLP

(57) ABSTRACT

The invention describes an embossing stamp comprising at least a base unit in which a retaining device is disposed on one side to retain a die plate holder and an operating device is disposed on a further side. The operating device is constructed such that it directly or indirectly acts on the retaining device, wherein a pivot of the operating device is disposed in the base unit. The base unit and/or the operating device are modular in construction, wherein the side walls are at least partially formed by panels which are positioned with respect to each other and fastened via half-shells and/or connecting means.

17 Claims, 15 Drawing Sheets

(56) References Cited

U.S. PATENT DOCUMENTS

| | | | | |
|---|---|---|---|---|
| 7,104,192 | B1 * | 9/2006 | Corcoran | 101/23 |
| 8,522,680 | B2 * | 9/2013 | Angevine | 101/28 |
| 2004/0118304 | A1 * | 6/2004 | Corcoran et al. | 101/28 |
| 2006/0230951 | A1 | 10/2006 | Petersen et al. | |
| 2012/0037015 | A1 | 2/2012 | Shih | |

* cited by examiner

EMBOSSING STAMP AND DIE PLATE HOLDER FOR THE EMBOSSING STAMP

CROSS-REFERENCE TO RELATED APPLICATIONS

The present application is a divisional of U.S. patent application Ser. No. 14/258,682 filed Apr. 22, 2014, which claims priority from Austrian Patent Application No. A 341/2013, filed Apr. 23, 2013, all of which are hereby incorporated herein by reference.

BACKGROUND OF THE INVENTION

The invention relates to an embossing stamp comprising a base unit in which a retaining device is disposed on one side and an operating device is disposed on a further side, and the operating device is constructed such that it directly or indirectly acts on the retaining device, wherein a pivot of the operating device is disposed in the base unit, and a die plate holder comprising an upper and lower embossing plate retainer which are connected together via a guide strip.

Embossing stamps, also known as plier seals, are known and used for the production of a relief without colour on documents/papers or photographs. The document/paper or photograph is positioned between two die plates. Next, the plier seal is pressed together so that a relief is formed on the document/paper or photograph by the dies disposed in the plier seal. Embossing stamps or plier seals have many uses. They provide documents, certificates, brochures, invitations, business cards etc. or even napkins with an exclusive look. Many people produce their own invitations and create monograms and designs for them. A further aspect is to enhance security against forgeries, and so appropriate seals for businesses, notaries, organizations, architects or engineers can be created, manufactured and used.

A general example is known from DE 20 2011 100 743 U, which comprises a base unit (base), an operating device (push lever) and a die plate holder (embossing unit). The operating device here is pivotally connected to the base via a pivot, wherein the operating device is constructed such that it acts directly in a retaining device disposed in the base. The operating device therein is formed by a lever which is divided into two power arms. To emboss, the item to be embossed (paper) is inserted into the die plate holder which is positioned in the retaining device on the base unit and then the user exerts a downwardly directed force P1 on the first end of the operating device using the operating device. Thus, the distance between the first downwardly exerted force P1 and the pivot constitutes the first power arm. As the operating device pivots downwards, a second force P2 is exerted, and the distance between the second downwardly directed force P2 and the pivot constitutes the second power arm. The moment of the first force P1 and the moment of the second force P2 are identical.

The disadvantage here is that the design/dimensions of the operating device mean that both downwardly directed forces P1 and P2 are of the same magnitude, and thus a very high effort is required in order to produce a relief in a document/paper or photograph.

Furthermore, an embossing stamp is known from DE 20 2011 100 743 U1 which discloses a base unit (base), an operating device (push lever) and a die plate holder (embossing unit). The operating device here is pivotally connected to the base via a pivot, wherein the operating device is constructed such that this now acts indirectly, via a pressure element which is mounted on the operating device and on the base unit, on a retaining device disposed in the base.

The disadvantage of such a solution is that the manufacturing costs are very high since a lot of individual parts have to be assembled together.

BR 8404986 A discloses an embossing stamp which again is formed by a base unit with a retaining device, an operating device in the form of a lever and a die plate holder. The lever here is mounted via a pivot above the retaining device in the base unit. The base unit is formed by two separate lamellar side walls which are connected together via separating elements, spacers, screw connections etc. To this end, appropriate recesses, slots, holes or the like are provided in the lamellar side walls. The operating device, in particular the one-piece lever, is pivotally mounted between the two lamellar side walls about a through shaft. The parts of the embossing stamp are formed here from metal so that it can withstand these comparatively high compressive forces.

The disadvantage in this case is that with a construction of this type, again a very large number of individual parts are required which have to be assembled manually. This means that manufacturing requirements are very high, and so very high manufacturing costs are also unavoidable. A further substantial disadvantage is that the embossing stamp has to be provided with outwardly directed feet so that it can be placed upright since, because the side walls are thin and lamellar, the footprint area is only small. Moreover, the outwardly projecting feet mean that the embossing stamp is very user-unfriendly because when it is held in the hand, the feet get in the way.

Because of the large forces involved in an embossing procedure, screw connections frequently loosen or undo and the structure becomes very wobbly. The user then has to tighten the screw connections by hand to make the embossing stamp functional again. In addition, constructing all the parts from metal means that the embossing stamp is very heavy, making handling of it more difficult.

U.S. Pat. No. 1,646,612 discloses an embossing stamp which has recessed grips disposed on the base unit. This means that the user can hold the plier seal securely in the hand. However, the disadvantage is that it is not possible to stand the plier seal upright on a flat surface. Thus, it is also not possible to carry out what is known as tabletop embossing, where the embossing stamp is placed on a table and the user presses the lever downwards. This embossing procedure is used when very high compressive forces are required, since when this type of embossing procedure is employed, the user can also make use of their body weight. However, in order to be able to carry this out, a stable stand for the plier seal is required.

Furthermore, an embossing stamp is known from U.S. Pat. No. 2,187,773 A wherein a retaining device for a die plate holder is disposed at an angle to the footprint area. This also discloses that the die plate holder can be inserted into the base unit. The disadvantage here is that fastening of the die plate holder in the retaining device is not optimal. A further disadvantage is that by disposing the die plate carrier in the base unit, it is not secured against slipping out.

SUMMARY OF THE INVENTION

Thus, the aim of the invention is to provide an embossing stamp and a die plate holder which are easier to manipulate and much easier to manufacture. At the same time, the disadvantages discussed above should be avoided.

The aim of the invention is achieved by means of an embossing stamp wherein the base unit and/or the operating device are constructed in a modular manner, wherein the side walls are at least partially formed by panels which are positioned and fastened to each other by means of half-shells and/or connecting means. Advantageously, this means that the modular construction results in a considerable reduction in weight, thereby considerably improving operator comfort. At the same time, the embossing stamp becomes very stable, since in those regions where a large force is exerted or a high load is applied, appropriate materials are employed which can withstand these actions. In this manner, a very high embossing quality can be ensured for a very low weight and structural shape. A further advantage is that the use of half-shells in which the panels, in particular side walls simply have to be inserted means that manufacture is greatly simplified and only a few, in particular the pivot and connecting means or additional cross-connections are required on the base unit, whereas in the prior art, a plurality of such cross-connections have to be manufactured manually. A further essential advantage of the panel construction is that this means that the panel elements can easily be manufactured in an ergonomic design, something which was largely impossible or only achievable at high cost in the prior art using bending or overturning procedures. In this manner, the panel elements and the associated half-shells, which are preferably produced from a plastic, can be aligned, thus considerably improving the handling properties. In addition, the power which can be applied for an embossing procedure is improved, and so the user does not need to apply as much force in order to produce a perfect embossed impression.

Advantageously again, the side walls of the base unit and/or the operating device are formed from a metal panel, carbon panel or aluminium panel, since this endows the embossing stamp with great rigidity. In this manner, deformation of the base unit is prevented or minimized, so that the transfer of force from the operating lever to the die plate holder is as good as possible. The more stable the pliers, the higher will be the impression or embossing quality. Since using panel elements means that bending or overturning processes no longer have to be carried out, it is also possible to use brittle, non-bendable materials.

In one embodiment in which the half-shells and/or connecting means are formed from plastic and are formed in one or more pieces, this advantageously means that weight is reduced by using plastic parts. This increases handling or user-friendliness of the embossing stamp. This also considerably improves the grip properties for the user, since cold metal no longer has to be grasped.

Advantageously again, the half-shells comprise cross-connections and the half-shells, in particular the cross-connections, are constructed to as to be interconnectable; in this manner, they can be assembled very quickly and easily. It is thus not necessary to train or employ specially trained personnel for assembling the embossing stamp, thereby reducing assembly costs.

Advantageously again, the cross-connections are formed as snap connections, spacers, mounting elements, guide elements, etc., so that to assemble the individual parts, they only have to be pushed together and simple assembly or interconnection results in attaching and positioning the individual parts.

In an advantageous embodiment, the base unit is constructed from a plastic-metal combination, wherein the half-shells are formed from plastic in which one or more metal parts, in particular a side wall, can be inserted, wherein to this end appropriate housings for the metal parts, for example in the form of guides, depressions or snap connections are provided; this provides the best possible stability for the lowest weight of the embossing stamp and simultaneously reduces assembly costs.

In a further advantageous embodiment, one or more reinforcing elements are integrated into the half-shells and/or connecting means for stabilization and reinforcement, since in this manner the stability can be further increased and thus the stamp quality is improved. Special inserts in specific regions mean that a spot stability improvement can be accomplished, wherein the increase in weight is minimized. This also means that superfluous material in other locations can be dispensed with.

In one embodiment in which the half-shells extend over the entire side wall, the reinforcing elements disposed in the side walls are advantageously protected thereby. Thus, even shock-sensitive materials can be used.

The aims of the invention are achieved by means of an embossing stamp in which a handle is provided in the base unit to accommodate several, in particular three of the user's fingers and the handle, in particular the gripping position, is preferably disposed at least partially above the retaining device. Advantageously, the arrangement of the handle in the base unit means that a compact structure is obtained. This also means that it is also possible for smaller hands to grasp it, since the distance between the operating device, in particular the lever, and the handle is smaller than is usually the case with a recessed grip in the region of the footprint area of the embossing stamp. A further essential advantage is, however, that the position of the fingers above the retaining device or die plate holder is such that a document/paper or photograph being introduced can no longer come into contact with the hand or fingers of the operator, as is known with prior art gripping positions in the region of the footprint area. In the prior art, the embossing stamp is preferably held such that the user takes it into the hand between the lever and the underside, i.e. the footprint area of the base unit and thus, when feeding the paper in, the latter can come into contact with the hand, meaning that paper cuts can occur. This is avoided by positioning the gripping position above the die plate holder in the embossing stamp of the invention.

In a further advantageous embodiment, the handle is formed by a finger hole, and the finger hole is preferably oval in shape and constructed so as to accommodate several of a user's fingers; in this manner, the user's fingers can grip the base unit more securely. The elongated construction of the finger hole is advantageous since in this manner, sufficient space is made available for the fingers. At the same time, however, the user can choose their position in the finger hole according to preference. In general, however, it is possible for the finger hole to include recessed grips, positional recesses or retaining positions for the fingers so that the positions for the various fingers are largely predetermined.

In a further advantageous embodiment, a footprint area is disposed on the base unit, on which recessed grips are provided to accommodate several of the user's fingers; this provides a further opportunity for securely holding the embossing stamp.

In a yet still further advantageous embodiment, two different gripping positions are provided for actuation, wherein the first gripping position is formed by the operating lever and the handle in the base unit constructed for several fingers and the second gripping position is formed by the operating lever and the recessed grips disposed on the footprint area; in this manner, the operator can operate the embossing stamp via the finger hole or the recessed grips, according to preference. More advantageously, this further second holding position produces a longer distance to the lever, so that personnel with large hands could use this position preferentially, whereas personnel with smaller hands, as is often the case with women, will prefer the position with the finger hole. In this manner, the handling properties are substantially improved for both men and women.

More advantageously, the footprint area is constructed such that tabletop embossing can be carried out together with the operating lever, and in this manner, in addition to the two gripping positions discussed above, an additional operating possibility is generated, so that three different operating possibilities are implemented with an embossing stamp or a plier seal. Tabletop embossing has the advantage that when operating the lever, the user can also use their body weight. In this manner, the highest possible force can be applied.

The aim of the invention is also achieved by means of an embossing stamp in which a levering movement of the lever is limited by a stop which is preferably formed by the locking lever or an axle or a stop rod in combination with a recess in the lever. Advantageously, in this manner, for example during an embossing procedure, the user can move the lever 7 only as far as a specific position, so that the embossing stamp cannot be damaged or the user's hand cannot be injured. At the same time, the lever cannot go too far forwards or be pressed too far upwards. By defining the movement of the lever exactly, the operation of the embossing stamp is guaranteed to be safer.

In one embodiment, the locking lever is advantageously formed by a plastic cover and an axle; the locking lever fulfils two functions, wherein one function is the limitation of the levering movement and the further function is to lock the lever in a specific position.

In an advantageous embodiment, the recess is formed by an approximately horizontal guide recess and an approximately vertical locking recess, since in this manner, the special profile of the recess for the locking lever can be used as the stop and as the lock of the lever.

Advantageously, the locking lever, in particular the axle, limits the upward and downward movement of the lever via the guide recess, and the locking lever, in particular the axle, can be pushed into the locking recess in the embossing position.

In one embodiment, the axle is pivotally mounted on the base unit on one side; this is advantageous, since in this manner, it can now be operated from one side alone.

Furthermore, the aim of the invention is also accomplished by means of an embossing stamp in which the base unit is constructed so as to accommodate a die plate holder and the lever is constructed for fixing the die plate holder disposed in the base unit. In this manner, it can advantageously be stored in a compact manner. At the same time, the dimensions of the embossing stamp can be substantially reduced for transport. This construction is particularly suitable for sales display purposes, in particular in a blister package. Substantially advantageously, the die plate holder is fixed in the base unit by means of the lever, so that it can no longer fall out, as is the case in the prior art. This can be carried out simply by the user fixing the lever in the embossing position. At the same time, the recessed grip is advantageously also used to accommodate the die plate holder, saving a substantial amount of space.

In an advantageous embodiment, the lever includes a holding region for the die plate holder, in particular the embossing plate retainer; in this manner, attachment is optimized and secure. At the same time, the dimensions can be correspondingly reduced.

In the embodiment in which the lever is applied to the die plate holder and fixes the die plate holder when the die plate holder is inserted and the lever is fixed in a locked position, to and fro sliding of the die plate holder in the base unit is advantageously prevented.

The aim of the invention is also accomplished by means of a die plate holder in which the die plate holder is constructed as a hybrid structure in which the embossing plate retainer is formed from plastic and the guide strip is formed from a resilient material or plastic, in particular a high performance plastic with resilient and abrasion-resistant properties. Advantageously thereby, the combination of the various materials allows for optimized matching of the corresponding aims. Thus, for example, a highly resilient material can be used in order to ensure that in the rest position, the die plates are separated from each other by the appropriate distance, whereas in the plastic part, optimized matching for accommodation in the retaining device can occur. Since the embossing plate retainer is formed by an injection moulded part, it is substantially easier to create special shapes or structures than when it is formed from a metallic material.

The aim of the invention is also achieved by means of a die plate holder in which an angled surface and/or a projection with an angled guide web or guide surface is disposed at least at a front zone or in particular circumferentially of the embossing plate retainers, in particular to enlarge an infeed opening. In this manner, the infeed openings between the embossing plate retainers or the die plates are advantageously enlarged in a simple manner. At the same time, the angled or inclined profile creates a guide wherein the document to be fed in is guided into the space between the die plates. In this manner, it is now possible for the die plates to be positioned as close to each other as possible, so that an optimized embossing stroke is obtained. If the die plates were to be disposed far away from each other in order to produce a sufficiently large infeed opening, then the travel of the lever would have to be very long in order to be able to carry out the embossing procedure, whereas when the die plates are close together, only a small travel is required. In this manner, such a simulated enlargement of the infeed opening is a substantial advantage for the user.

The aim of the invention is also achieved by means of a die plate holder wherein an embossing plate retainer, in particular the lower, comprises guide slots and preferably a cross-link for guiding and fixing an embossing stamp. Advantageously here, even in the starting phase when inserting the die plate holder in the embossing stamp, the die plate holder is guided so that simplified and secure insertion is obtained. In this manner, the same position of the die plate holder is obtained repeatedly so that the embossing position is permanently optimized.

The aims of the invention are also achieved by means of a die plate holder in which the die plate holder is formed in one piece from plastic, in particular a high performance plastic wherein a metallic insert for the action of a lever of the embossing stamp is preferably disposed on the upper embossing plate retainer. In this manner, the die plate holder can be manufactured in a simple, cheap manner, wherein the metallic properties reduce the frictional resistance during an embossing procedure. In addition, destruction of the top face of the plastic by a multitude of embossing procedures is prevented. In this manner, the service life of a die plate holder produced from plastic is substantially increased.

In an advantageous embodiment, the embossing plate retainer comprises positioning means to align the die plates since in this manner, when manufacturing the die plate holder, when inserting the die plates, in particular by adhesion, they can be positioned exactly.

In an embodiment in which in the embossing plate retainers, the insertable die plates are fixed by means of a layer of adhesive, in particular a double sided adhesive tape, the die plates are made easy to remove. In addition, positioning is essentially easy since frequently during a pressing procedure, the die plates are easily displaced; this can be avoided by gluing them in.

In a further advantageous embodiment, a ring element with angled guide webs or guide surfaces can be attached to the embossing plate retainers to simulate an enlarged infeed opening; in this manner, the infeed opening can be retroactively enlarged. Such a solution can also, for example, be retrofitted to die plate holders 5 which are already in position.

The aims of the invention are also achieved by means of a die plate holder in which an index card for the embossed impression and/or to identify the die plate is disposed on or removable from an embossing plate retainer. In this manner, it is advantageously possible by means of this index card to display an embossed image or an identification of the die plate or the embossed image so that by looking at the index card, the user can identify the embossing stamp. This is of particular significance if an individual has to use a number of embossing stamps, since in the prior art, without making a test embossing, it is not possible to tell them apart; with an index card, this is now possible.

In a further advantageous embodiment, the embossing plate holder has a fastening means for the index card, since in this manner, even when the die plate holder is inserted, the image on the index card is visible.

Finally, in a further advantageous embodiment, the fastening means for the index card is formed by a swivel-lock hinge since in this manner, different positions of the index card can be set. In this manner, when the die plate holders are removed, the index card can be folded onto the casing so that it is compact in structure and at the same time is readily legible, and on the other hand when the die plate holder is inserted, the index card is adjusted so that it is possible to carry out an embossing procedure and in addition, to see the image on the index card.

BRIEF DESCRIPTION OF THE DRAWINGS

The invention will now be described in more detail with reference to the accompanying figures, which show.

DETAILED DESCRIPTION OF THE PREFERRED EMBODIMENT

Figure 1:
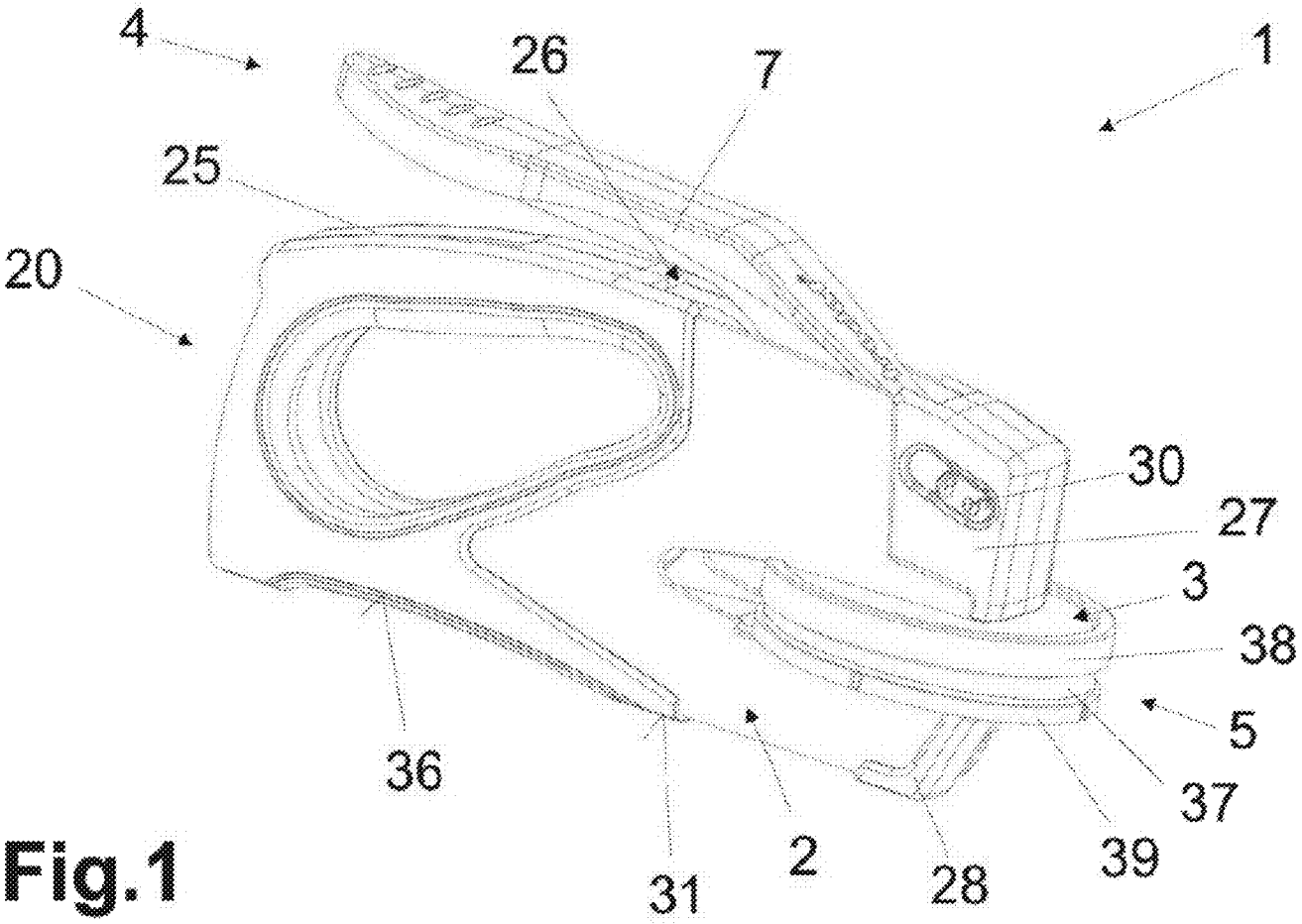
FIG. 1 is a perspective view of an embossing stamp with inserted die plate holder.

Firstly, it should be stated that in the various embodiments, identical parts are provided with identical reference numerals, whereby the disclosures in the description as a whole can be applied mutatis mutandis to identical parts with identical reference numerals. In addition, the positional information contained in the description, such as top, bottom, side, etc., for example, refer to the figure being described and shown at the time and should be applied mutatis mutandis to a new position when the position is changed.

Figure 2:
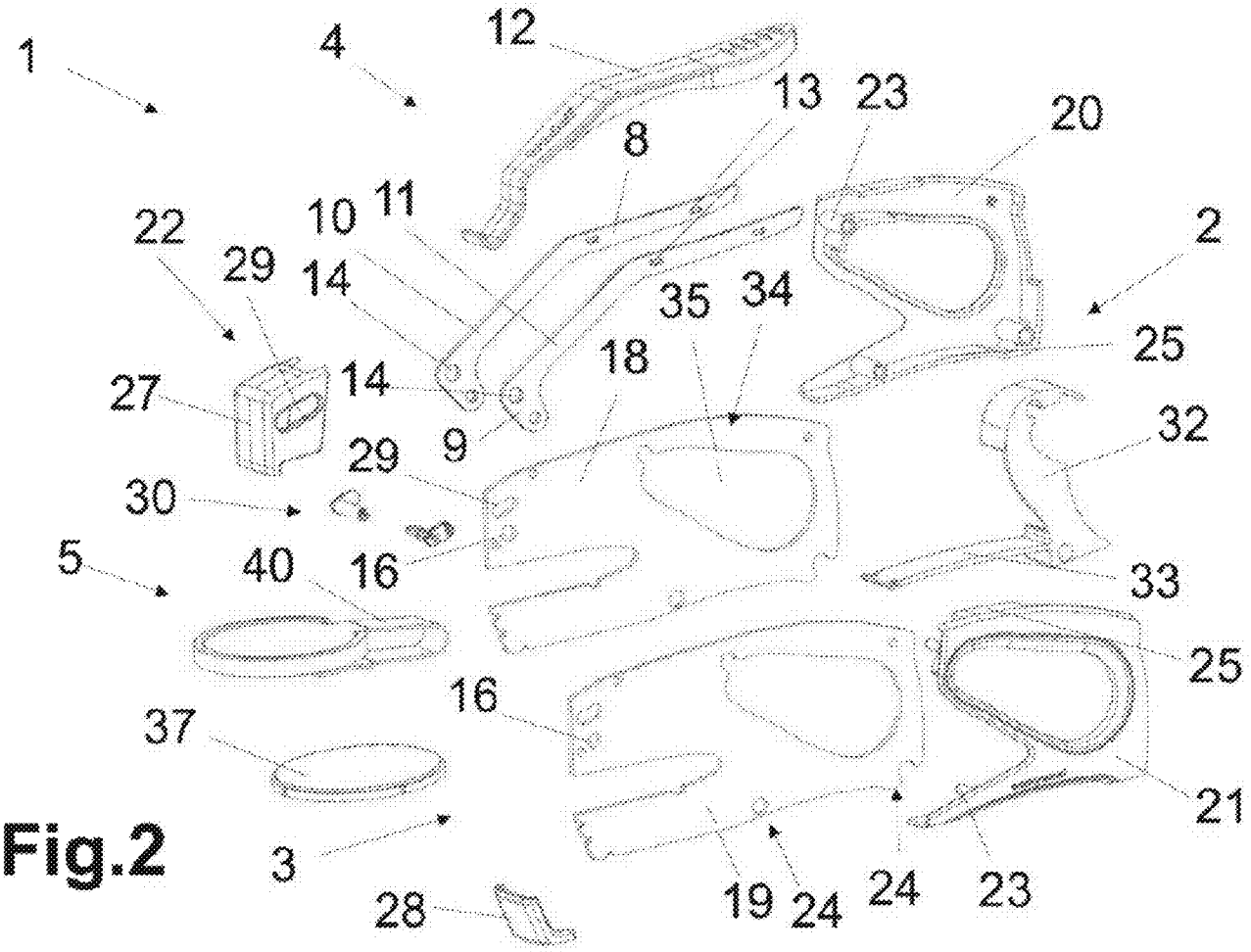
FIG. 2 is an exploded view of the embossing stamp in a simplified diagrammatic view.
Figure 3:
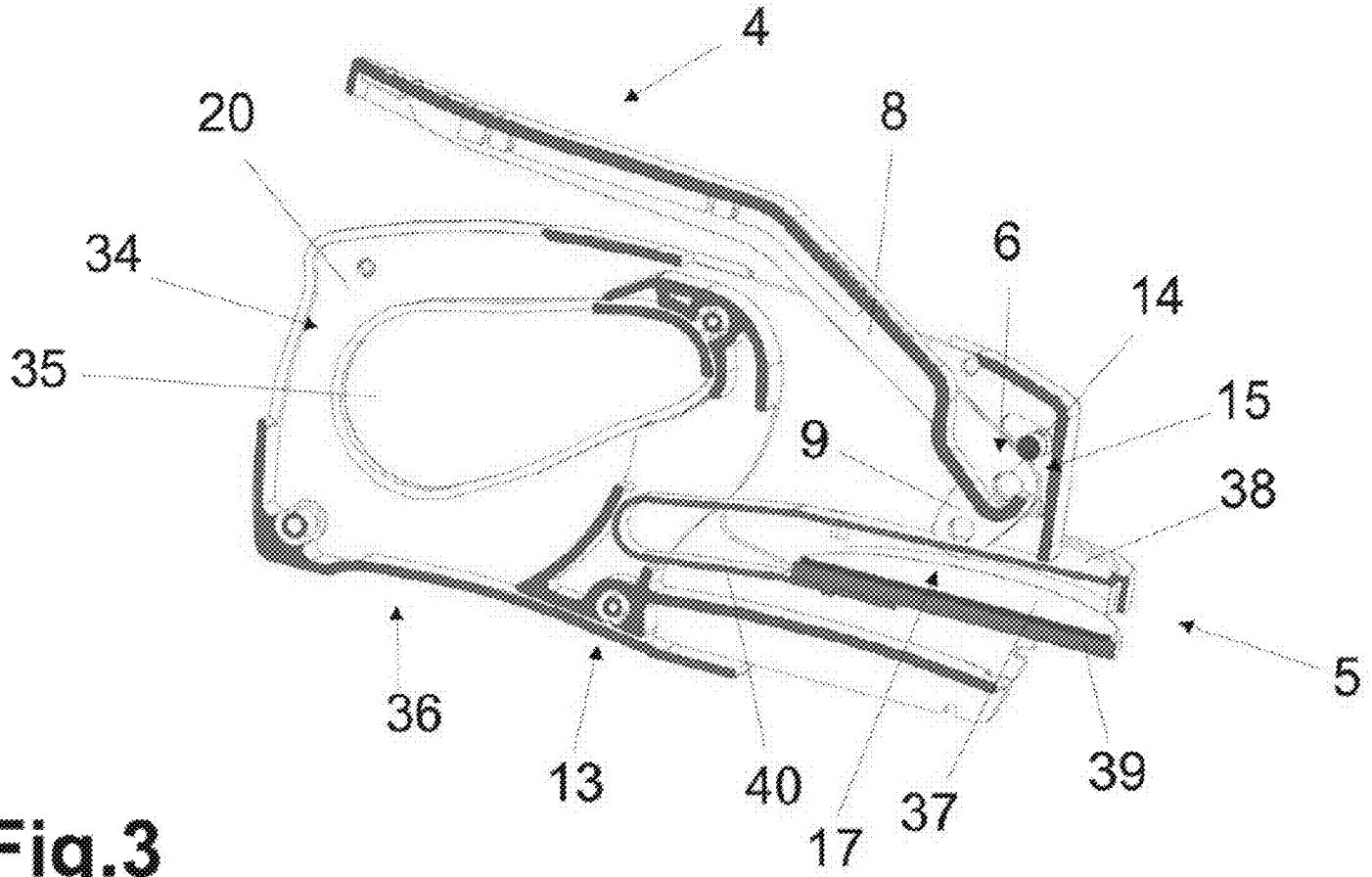
FIG. 3 is a sectional view through an assembled embossing stamp in a simplified diagrammatic view.

FIGS. 1 to 3 show an embossing stamp 1, or what is known as a plier seal, for the production of relief depictions (not shown) on documents, papers or photographs, wherein the relief is formed without colour. In order to make it possible to form reliefs, the embossing stamp 1 has to exert high pressures on the document, paper or photograph etc.; and so this has to be constructed in a very robust manner. In the prior art, embossing stamps 1 are always constructed from metal in order to avoid distortion of the embossing stamp 1 if large forces are applied. Thus, handling such a stamp is difficult because it is heavy. Embossing stamps are also bent from a piece of sheet metal/steel in order to obtain the appropriate rigidity.

The embossing stamp 1 of the invention is now formed from a plastic-metal combination as a panel construction. Simultaneously, the novel plier seal or novel embossing stamp 1 is advantageous, because assembly costs are kept as low as possible and hence the embossing stamp 1 is produced from as few individual parts as possible, however it can produce the highest possible flexural rigidity and stability for a very low weight.

The embossing stamp 1 comprises a base unit 2 one side of which has disposed therein a retaining device 3 and the opposite side of which has an operating device 4. The operating device 4 acts directly or indirectly on the retaining device 3, in particular on a die plate holder 5 disposed therein, i.e. when the operating device 4 is operated, i.e. during a pressing/embossing procedure, the die plate holder 5 is compressed. So that such a pressing/embossing procedure is possible, the operating device 4 is mounted in the base unit 2 via a pivot 6 or the pivot 6 of the operating device 4 is disposed on the base unit 2. The pivot 6 is thus positioned at the border region or infeed region of the base unit 2 above the retaining device 3.

In the embodiment shown, the operating device 4 is formed by a lever 7 which is assembled from several individual parts, as will be explained in more detail below. What is essential in the construction of the lever 7 is that it has two functions or part sections. This means that the lever 7 is divided into two part sections, on the one hand forming a thrust lever 8 and also a lift lever 9, as can best be seen in FIG. 3. The operating device 4 is thus formed by a lever 7 which simultaneously forms the thrust lever 8 and the lift lever 9 with a common pivot point (the pivot 6). The individual part sections or individual parts of the lever 7 are rigidly connected together and thus form an integral component which is only pivotally mounted via the pivot 6 in the base unit 2.

By constructing the lever 7 in part sections, an exact definition as regards the construction of the lever 7 is possible so that for as little as possible applied force or energy, little force or energy is lost and the highest possible force or energy acts on the retaining device 3 or is exerted on the die plate holder 5. By constructing the lever 7 in a precise manner and optimizing the positioning in the base unit 2, an optimal force is exerted on the die plate holder 5.

In the lever 7 of the invention, the special construction means that an increase in force occurs, i.e. for a defined force exerted on the thrust lever 8, a higher force is exerted via the lift lever 9 into the retaining device 3, in particular onto the die plate holder 5. Preferably, the lever 7, in particular the thrust lever 8, is constructed with respect to the lift lever 9 to produce a power ratio of 1:10 or more, i.e. at least to multiply the applied force by ten. This is achieved by making the lift lever 9 shorter than is known in the prior art. In this manner, a specific construction is required in the region of the pivot 6, since this has to be positioned as close as possible to the retaining device 4 so that the short lift lever 9 can act properly on the die plate holder 5.

In the embodiment of the invention, the lever 7 has two lamellar side walls 10, 11 which are positioned or held via a handle element 12 at a set distance apart. To this end, the side walls 10, 11 and the handle element 12 are provided with fastening means 13 wherein, for example, fastening holes are provided on the side walls 10, 11 and on the handle element 12, corresponding fastening pins are provided. It is also possible for a guide slot (not shown) to be provided on the handle element 12 for insertion of the side walls 10, 11, in order to further improve lateral guiding of the lever 7. In order to form the lever 7, the handle element 12 and the side walls 10, 11 are simply pushed together so that the fastening pins engage in the fastening holes and thus fix and hold both products 10, 11 via the handle element 12. Preferably, the side walls 10, 11 are formed from metal and the handle element 12 is formed from plastic. This means that very high forces can be exerted on the lever 7 and at the same time, slipping off is prevented by a non-slip or anti-skid plastic.

To mount the lever 7, the side walls 10, 11 each have a mounting hole 14 into which an axle element 15 can be inserted. The axle element 15 then simultaneously forms a separating element in order to hold the two side walls 10, 11 in the region of the pivot 6 at a pre-set distance apart. In this manner it is possible, for example, for the end regions of the axle element 15 to have a smaller diameter than the region between the side walls 10, 11, and the mounting hole 14 is matched to the smaller diameter. In this manner, when inserting the axle element 15, the end regions with the smaller diameter are inserted through the mounting holes 14 and then the side walls 10, 11 sit on the larger diameter of the axle element 15 and cannot be pushed further together. For mounting in the base unit 2, the axle element 15, in particular the ends, protrude through the side wall 10, 11 so that the axle element 15 is again placed in or is inserted in a further corresponding mounting hole 16 in the base unit 2. Clearly, it is possible for the axle element 15 to be formed in multiple parts.

The lever 7 is preferably L-shaped so that the two part sections are the thrust lever 8 and the lift lever 9, wherein the longer side, in particular the thrust lever 8, can have a special profile or shape. In this manner, the part section with the handle element 12 forms the thrust lever 8, which thus extends from the pivot 6 to the end of the handle element 12, whereas the second part section, for the lift lever 9, extends from the pivot 6 in the direction of the retaining device 3 and is constructed to act on the retaining device 3, i.e. extends to the contact site with the die plate holder 5.

As illustrated, it is also possible for the shape of the thrust lever 8 to be ergonomic, for example with a kink. This means that the distance between the handle element 12, in particular the surface of the handle element 12, and the base unit 2 is shorter and thus handling of the embossing stamp 1 is substantially improved. It is also possible for the end region of the lift lever 9 to comprise a pressure element 17, in particular a pressure roller. This means that when the embossing stamp 1 is operated, in particular during a pressing procedure, the action of the lift lever 9 on the die plate holder 5 causes it to roll or slide on the surface to minimize frictional losses. At the same time, a user-friendly pressing procedure is carried out when compressing the die plate holder 5, avoiding destruction of the surface at the die plate holder 5.

The base unit 2, like the operating device 4, in particular the lever 7, is modular in form, in particular formed as panels, and again is formed from several individual parts, as can be seen in more detail in FIG. 2. Here, a plastic-metal combination is also shown for the base unit 2, in order to obtain a very high rigidity for a very low weight. In the embodiment shown in FIGS. 1 to 3, side walls 18, 19 of the base unit 2 are each formed by a panel and positioned, held and fixed with respect to each other via half-shells 20, 21. The side walls 10, 11, 18, 19 of the base unit 2 and the operating device 4 are formed from a metal panel or carbon panel or aluminium panel; in this regard, materials are preferably used which have high rigidity or flexural rigidity and toughness, so that the user can exert as much force as possible on the embossing stamp 1 during a pressing procedure without it distorting. If it were to distort because of the force on the embossing stamp 1, in particular the base unit 2, then the quality of the relief to be formed would suffer greatly as then the full force necessary to form the relief would not be produced. However, in order to save weight, the half-shells 20, 21 and/or connecting means 22 are formed from plastic, wherein these parts preferably form the surfaces which are touched by the user, i.e. that region which the user's hand touches is formed from plastic; a secure grip is obtained when a non-slip plastic is used. A further advantage of the use of plastic is that the embossing stamp 1 no longer feels cool when picked up by the user, as is the case with known metal embossing stamps 1 of the prior art. In this manner, user friendliness is increased by using appropriate materials in the appropriate regions. In addition, manufacture of the individual parts is substantially facilitated, since bending processes no longer have to be carried out. The individual parts, in particular the side walls 10, 11, 18, 19, the half-shells 20, 21 and handle element 12 are preferably manufactured by stamping or cutting and by injection moulding.

As can best be seen in FIG. 2, the half-shells 20, 21 are disposed on opposite sides of the retaining device 3. The half-shells 20, 21 have cross-connections 23 so that when putting the two half-shells 20, 21 together via these cross-connections 23, the half-shells 20, 21 are held together. In this regard, the cross-connections 23 may, for example, be formed as snap connections, spacers, mounting elements, guide elements, etc., and be connected to the plastic part as one piece or form independent parts of metal or plastic which are positioned appropriately upon assembly. The essential feature of the construction of the half-shells 20, 21 is that the side walls 18, 19 of the base unit 2 are at least partially housed, fixed and retained. In the embodiment shown, the side wall 18, 19 extends over the entire inner region of the half-shell 20, 21 so that the side wall 18, 19 simultaneously acts as a support body for the half-shell 20, 21, i.e. the side wall 18, 19 has corresponding recesses 24 in the regions of the cross-connections 23 and simultaneously are positioned via the cross-connections 23 on the side walls 18, 19 over the half-shells 20, 21 so that when guiding or assembling the two half-shells 20, 21 together, the side walls 18, 19 are held at a defined distance with respect to each other. Since the side walls 18, 19 are completely integrated into the half-shells 20, 21, the thickness of the material of the half-shells 20, 21 can be reduced, since the rigidity and toughness is increased by the side walls 18, 19.

The half-shells 20, 21 also have a sealing surface 25 which runs over the outer contours which is constructed such that when the two half-shells 20, 21 are assembled, they sit face to face and produce a flat surface over the entire width of the base unit 2. In this manner, a gap 26 is formed between the side walls 18, 19 because of the lamellar side walls 18, 19, which is at least partially covered or closed off by the half-shells 20, 21, which also results in an improvement to the grasping properties and thus of the handling properties, since the half-shells 20, 21 are disposed in grasping regions.

Fixing of the side walls 18, 19 is carried out by the half-shells 20, 21 in the embodiment shown on one side of the base unit 2 (holding side) so that the other side (take up side) can also be reinforced or held with appropriate elements, in particular the connecting means 22 in order to increase the stability. To this end, for example, a cover 27 and a foot element 28 are provided which are formed such that they can easily be inserted onto the end regions, in particular the face of the side walls 18, 19 and then they can be snap-fitted as appropriate and the side walls 18, 19 can be fastened together. In this regard, the cover 27 and the foot element 28 are formed as a single piece and extend over the entire width of the base unit 2. Clearly, it is possible for further half-shell-shaped elements to be used or inserted for these elements or for this side of the base unit 2.

The cover 27 is thus applied above the retaining device 3, and preferably extends over the pivot 6 and includes the pivot 6. This means that for the pivot 6, a lateral guide is provided and thus it can no longer fall out of or protrude out of the base unit 2. Furthermore, the cover 27 has a longitudinal opening 29 in which a locking lever 30 can be inserted. This locking lever 30 is intended to fix the lever 7 in a specific position. To this end, the lever 7 is pushed downwards into the pressing or embossing position so that the shell lever 30 can be pushed in the direction of the holding side, in particular in the direction of the half-shells 20, 21, and thus prevents the lever 7 from swinging back, since the shell lever 30 locks the lever 7 in the locking position. To release the lever 7, the locking lever 30 only needs to be pushed in the opposite direction so that it can then once more move freely.

Below the retaining device 3 in the region of the retaining side, the foot element 28 is inserted on the face of the side walls 18, 19. This extends, for example, to below the retaining device 3 and over a defined length to the footprint region, i.e. to the underside of the base unit 2. In this manner, the foot element 28, with the half-shells 20, 21 on the underside of the base unit 2, forms a footprint area 31 so that the embossing stamp 1 can be set on a flat surface without it falling over or tipping over onto one side. The plastic elements thus simultaneously protect against slipping. Clearly, it is possible for additional non-slip elements to be attached to the plastic elements or for these to be integrated directly upon manufacture i.e. a so-called two-component plastic is used for the plastic parts. This is also possible for the handle elements 12 and/or half-shells 20, 21.

In order to further increase the rigidity, it is possible to integrate further insert elements 32 of this rigid/high-strength material in addition to the side walls 18, 19. To this end, in this embodiment in the region of the footprint area 31, a floor element 33 is inserted. This can, for example, be fixed via the half-shells 20, 21 and the foot element 28 or be connected directly with one of the side walls 18, 19. In addition, it is also possible to use appropriate insert elements 33 formed from plastic or other materials for the plastic elements.

In the solution of the invention, care is taken that all of the elements are easy to assemble so that screw connections can be avoided. The individual parts shown are preferably pushed together or riveted so that rapid, simple assembly is possible. What is essential here is simply that the individual parts or reinforcing parts are designed such that during an embossing procedure, distortion of the embossing stamp 1, in particular the individual parts, should be avoided in order to maintain very high. relief-forming quality.

As can now be seen from the embodiment, the embossing stamp 1, in particular the base unit 2, has a special handle 34 so that with an embossing stamp 1 of the invention of this type, three different embossing procedures or gripping positions are possible.

The handle 34 is in the preferred form of an oval finger hole 35 in the base unit 2, wherein the handle 34 is designed to accommodate several of the user's fingers, in particular three fingers. The handle 34 in combination with the operating device 4, in particular the lever 7, forms the first gripping position; to this end, the user picks up the embossing stamp 1 in their hand so that the thumb or palm of the hand lies on the lever 7 and the fingers are in the handle 34 so that by closing the hand, the operating device 4, in particular the lever 7, is pulled or moved in the direction of the base unit 2. In this manner the handle 34, in particular the finger hole 35, is disposed at least partially above the retaining device 3, i.e. the gripping region, in particular the gripping position is at least partially above the retaining device 3 for the handle 34 in the base unit 2 and can extend behind the retaining device 3, with care preferably being taken that the position of the fingers, i.e. the gripping position, is always above the retaining device 3 in the base unit 2. In this manner, when the user holds the embossing stamp 1 in the first gripping position, i.e. with the lever 7 and the handle 34, the fingers of the user are positioned above the retaining device 3 even when the finger hole 35 extends laterally behind and below the retaining device 3, since the fingers are still in the upper region of the finger hole 35 during compression.

This constitutes a substantial advantage over the prior art, since when feeding in a document, paper or photograph etc. into the retaining device 3 or into the die plate holder 5 positioned in the retaining device 3, the user no longer comes into contact with the document, paper or photograph and thus can no longer be injured, since the gripping position is located above the die plate holder 5. In the prior art, embossing stamps 1 are always held so that the thumb lies on the lever 7 and the fingers grip around the bottom of the embossing stamp 1 so that when inserting paper, it frequently comes into contact with the surface of the hand or a finger and injures it, in particular cutting the skin; this is no longer possible with the gripping position of the invention.

Holding of the type which is known in the prior art is also possible with the embossing stamp 1 of the invention and constitutes the second gripping position. Here, on the underside of the embossing stamp 1, in particular on the footprint area 31, the half-shells 20, 21, recessed grips 36 are provided for fingers, so that the user holds the embossing stamp 1 in the second gripping position such that he holds the thumb or palm of the hand over the operating device 4, in particular the lever 7, and the fingers are placed in the recessed grips 36 under the base unit 2. However, this gripping position runs the risk of injury, as mentioned above.

In this manner, it is possible to operate using two different gripping positions, wherein the first gripping position is formed by the operating device 4 and the handle 34 formed for several fingers in the base unit 2 and the second gripping position is formed by the operating device 4 and the recessed grips 36 formed on the footprint area 31. It can thus be stated that the first gripping position is preferentially used by individuals with smaller hands, in particular women, whereas the second gripping positions are used by individuals with large hands, in particular men.

The third position, in particular also known as the tabletop position, for producing a relief, can be executed when the embossing stamp 1 is placed on a flat surface, in particular a table or desk, so that the user can push the operating device 4, in particular the lever 7, using the hand, in particular the palm of the hand. In this manner, frequently only the palm of the hand is rested on the handle, in particular lever 7, and then pushed downwards so that the individual can use their entire body weight. The positions two and three are known in the prior art, whereas the first position is possible for the first time.

It is also possible for the handle 34, instead of the finger hole 35, to be formed by a stirrup for the fingers integrated into or fastened to the base unit 2. In this manner, the stirrup may be slightly bent, like the upper region of the finger hole 35. The stirrup is again positioned above the retaining device 3 or behind the retaining device 3 in order to avoid touching the document being fed in. It is only essential that again, for the embossing stamp 1 of the invention, three embossing positions, in particular the first and second gripping positions and the tabletop position, are available. The essential advantage is that in this manner, the plier seal 1 is suitable for male and female individuals with large and small hands. If an individual with small hands uses the embossing stamp 1, then the first gripping position is particularly suitable as the lever 7 for the thumb or palm and the handle 34 for the fingers are as close to each other as possible. However, if the same embossing stamp 1 is used by an individual with large hands, then this individual can use the second gripping position in which the distance between lever 7 and recessed grips 36 is greater. In this manner, any individual can hold the embossing stamp 1 in an optimized manner and apply the highest possible force. In the third position, in particular the tabletop position, the size of the hands is not relevant, since the embossing stamp 1 simply stands and the lever 7 is pressed from above in the direction of the base unit 2 or footprint area 31.

However, in order to be able to carry out an embossing procedure at all, it is necessary for the die plate holder 5 with its die plates 37 disposed therein to be inserted in the embossing stamp 1. The die plate holder 5 comprises an upper and a lower embossing plate retainer 38, 39 which are connected together via a guide strip 40, wherein the embossing plate retainer 38, 39 for the die plates 37 and for the guide strip 40 is formed from plastic. The die plate holder 5 is unitarily formed from plastic, in particular from a high performance plastic, wherein a metallic insert is disposed, preferably on the upper embossing plate retainer 38, 39, 75, 76, for the action of the lever 7 of the embossing stamp 1. Preferably, the particular plastic employed is a high performance plastic with the designation PEEK, PPS, PSU, PES, PTFE, etc., but clearly other plastics, not named here, may be used, in particular if they have similar properties. It is also possible to form the die plate holder 5 as a hybrid structure in which the embossing plate retainer 38, 39 is formed from a plastic and the guide strip 40 is formed from a resilient material or from plastic, in particular a high performance plastic with resilient and low abrasion properties.

The width of the guide strip 40 is such that it fits in the gap 26 between the two side walls 20, 21 of the base unit 2. In this manner, the side walls 20, 21 simultaneously form the lateral guide for the die plate holder 5. Preferably, the embossing plate retainer 38, 39 and the corresponding die plates 37 are rounded in shape and protrude on both sides laterally out of the base unit 2, as can be seen in FIG. 1.

Connecting the embossing plate retainer 38, 39 via the guide strip 40 means that the two embossing plate retainers 38, 39 and thus also the die plates 37 disposed therein are distanced from each other by a specific amount. However, if the die plate holder 5 is introduced into the retaining device 3, then the given slide track of the retaining device 3 in the base unit 2 is designed such that both embossing plate retainers 38, 39 are pressed together slightly. In this manner, an appropriate force is produced on the lever 7, in particular on the lift lever 9, so that the lever 7 is pushed upwards. This means that after an embossing procedure when the force on the lever 7 is released, it is automatically returned to the start position and a fresh embossing procedure can then immediately be carried out, i.e. the return action of the lever 7 to the start position, known as the rest position, is carried out via the die plate holder 5. Furthermore, the slide track is constructed such that it opens easily and thus the die plates 37 in the front region, where the document, paper or photograph etc. is fed in, have a larger separation than in the back region. In this manner, feeding in a document, paper or photograph etc. is made substantially easier.

In general, then, it can be stated that when the lever 7 is operated, i.e. when carrying out an embossing procedure, the lever 7 presses on the top side of an embossing plate retainer 38 and this is then pressed downwards in the direction of the second embossing plate retainer 39, whereupon the relief on the die plates 37 is pressed into the inserted document, paper or photograph etc.

So that the die plate holder 5 cannot be inserted the wrong way round, it is possible for a positioning means to be provided on one of the two top faces of the embossing plate retainers 38, 39, for example in the form of a projection (not shown). Correspondingly, a matching cover is provided or attached to the base unit 2 so that when inserted, the positioning means can be accommodated in the cover and thus the die plate holder 5 can be pushed in completely. A further possibility for ensuring it is put in the right way round is in the construction of the guide strip 40, which must have a profile which enables it to be pushed into the slide track of the retaining device 3.

In general, it should be mentioned that the plastic elements, in particular the handle element 12, the half-shells 20, 21 of the cover 27 and the footprint 28 may have deformable fastening means, guide elements, snap-fit elements etc. which are deformed to assemble the elements but then swing back into the original position and thus fix, fasten, snap-fit or clamp etc. the side walls 20, 21 or lamellar elements.

It should also be mentioned that the base unit 2 is formed from the two half-shells 20, 21 and in the half-shells 20, 21 a panel in the form of the side wall 18, 19 is partially or completely inserted for the purposes of reinforcing, i.e. the half-shells 20, 21 formed from plastic as well as the side walls 18, 19 of the base unit 2 structure and within the half-shells 20, 21 as part sections, one or more panels or the whole side can be formed from a metal or other materials and inserted, i.e. that a complete or spot reinforcement can be obtained via one or more panels. In this manner it is also possible for an appropriately sized recess to be present in the half-shells 20, 21 and thus any panels disposed therein are visible. This type of construction has the advantage that firstly, all elements such as the lever 7, reinforcing panels etc. are inserted into the half-shells 20, 21 and the embossing stamp 1 is produced in a single step by assembling both half-shells 20, 21. This also means that it is possible, for example, for the lever 7 to be formed from a single injection moulded part in which an appropriate reinforcing insert is co-moulded or is subsequently inserted or pushed into appropriate recesses or guides.

FIGS. 4 to 12 show a further embodiment of an embossing stamp 1 formed as panels, wherein the main difference is in the construction of the plastic parts and the design of the embossing stamp 1.

Figure 4:
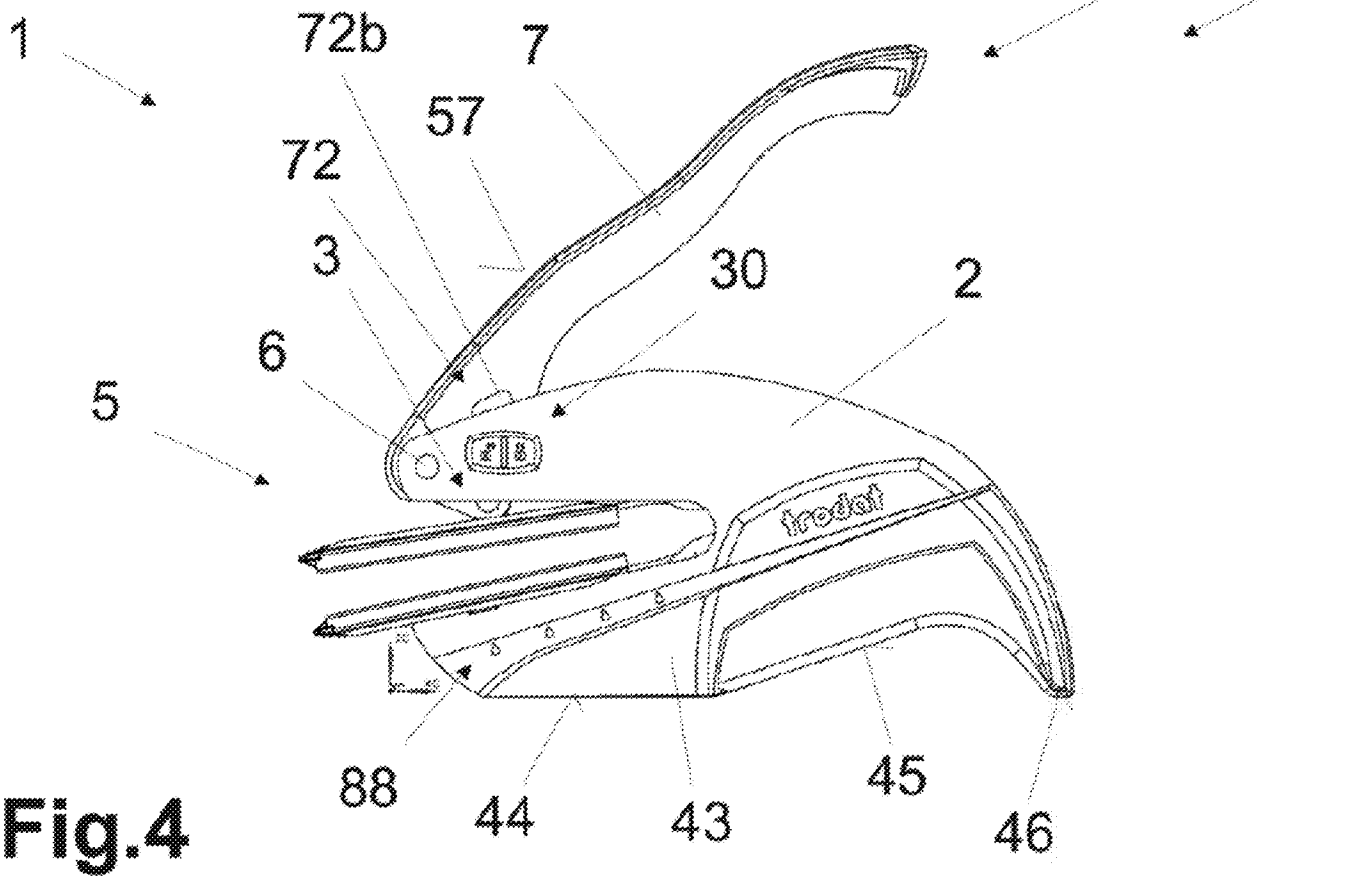
FIG. 4 is a further embodiment of an embossing stamp in the rest position, in side view and in a simplified diagrammatic view.
Figure 5:
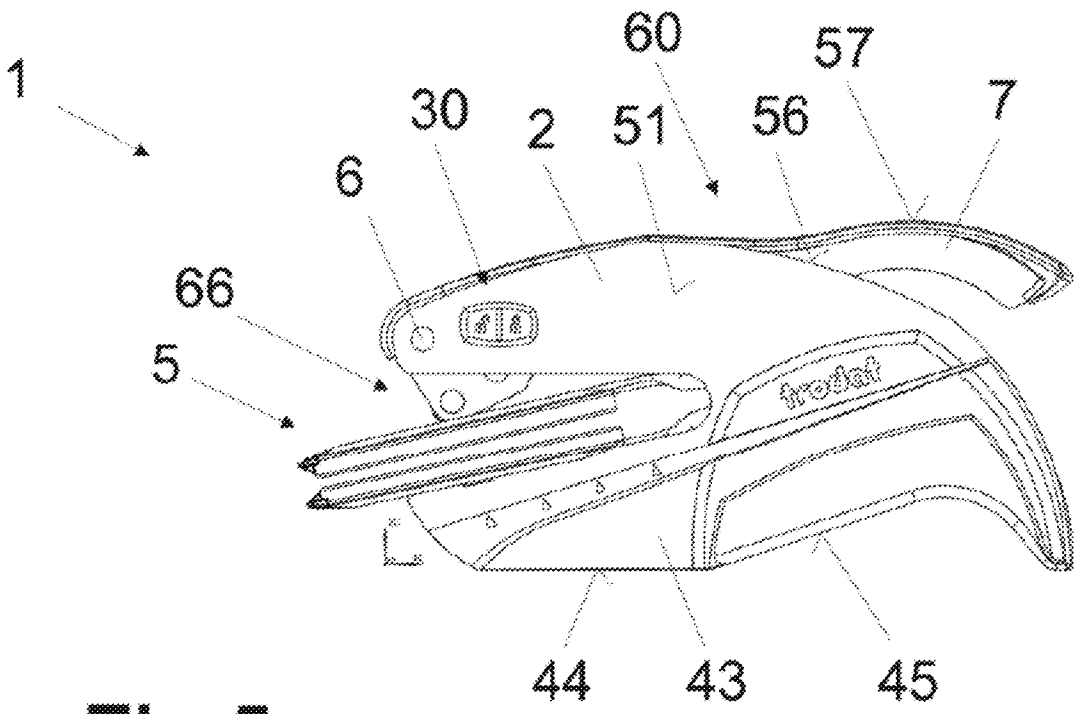
FIG. 5 is a further side view of the embodiment of FIG. 4 in the embossing position, in a simplified diagrammatic view.

Thus, FIG. 4 shows an embossing stamp 1 in a rest position 41 in which the die plate carrier 5 pushes the lever 7 upwards and the die plate carrier 5 is open to feed in a document (not shown), i.e. the die plate carrier 5 has a resilient property so that in the rest position 5, the lever 7 is pushed upwards and the die plate carrier 5 is open. In contrast, in FIG. 5 the embossing stamp is in the stamping position 42 or embossing position 42, wherein for clarity, there is no document in the closed die plate carrier 5, i.e. because the lever 7 has had pressure exerted upon it, the resilient die plate carrier 5 has been pressed together and thus the lever 7 is pushed downwards so that after the pressure is released, the lever 7 is moved again from the die plate carrier 5 into the rest position 5.

The base unit 2 in the embodiment shown now has a substantially different construction having regard to the design and arrangement of the plastic parts, wherein in this embodiment the handle 34, in particular the finger hole 35, is no longer used, i.e. in this variation, only two gripping positions are available, since the first position via the finger hole 35 of the embodiment of FIGS. 1 to 3 has been dispensed with.

Figure 6:
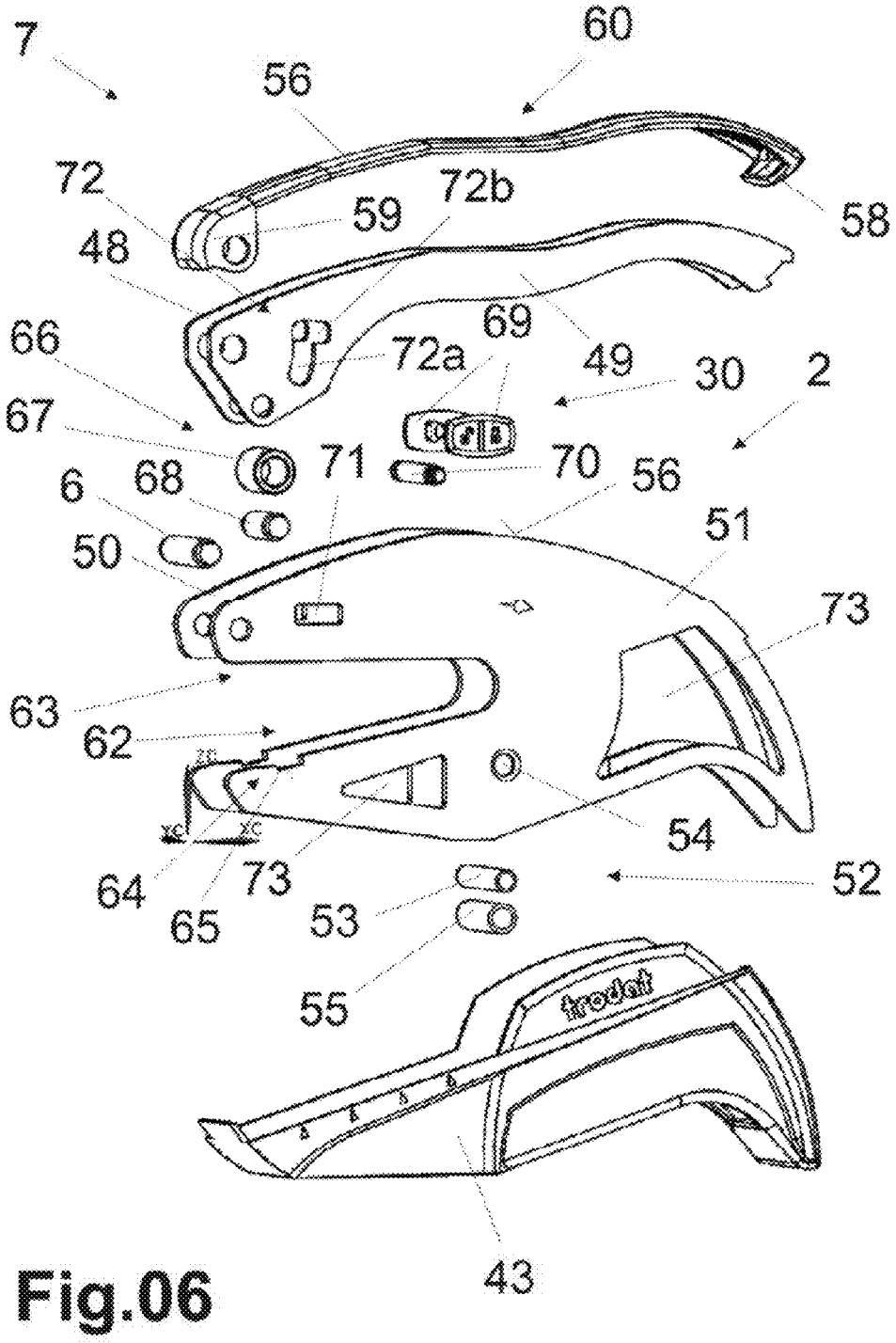
FIG. 6 is an exploded view of the embodiment of FIG. 4 or FIG. 5, in a simplified diagrammatic view.

Now, the base unit 2 is formed with a one-piece half-shell 43, as can be seen in FIG. 6, wherein this now forms the lower region of the base unit 2, but clearly it is possible for the half-shell 43 to again be formed in multiple parts. The half-shell 43 extends under the retaining device 3 over a footprint area 44, a recessed grip 45 to a support point 46 in the end region of the embossing stamp 1. In this manner, all essential regions are provided from plastic for the embossing procedure, i.e., for example, in the first position the user picks up the embossing stamp 1 via the recessed grip 45 and the lever 7; the plastic construction means that the recessed grip 45 is safe and pleasant to hold. If, for example, the embossing stamp 1 is placed on a table for the second embossing position, then again, all contact points, in particular the contact surface 44 and the support point 46, are provided with plastic, so that slipping of the embossing stamp 1 is prevented.

So that the user in the first gripping position can also hold the lever 7 in a safe, non-slip manner, again, the lever 7 is provided with a gripping element 47 formed from plastic. The plastic parts, as described above, comprise appropriate means, in particular slots, clips, snap connections, etc. in order to form the side walls 48 to 51 or panel elements 48 to 51 for the lever 7 and the base unit 2 from metal or high-strength materials. In this manner, these side walls 48 to 51 correspond to the side walls 10, 11 and 18, 19 in the embodiment of FIGS. 1 to 3.

However, so that the side walls 48 to 51 can gain even more stability, at predetermined points, connecting means 52 which are preferably in the form of spacer pins 53, are disposed; corresponding openings 54 are provided for them in the side walls 48 to 51. This also means that via the spacer pins 53, a spacer tube 55, preferably formed from plastic, is inserted into the spacer axle 53. In the embodiment shown, only one additional connecting means 52 is provided on the base unit 2, since for the lever 7, the additional connection is provided by the required pivot 6. The pivot 6 thus provides both the lever 7 and the base unit 2 with additional stability in the upper front region.

In this regard, the lever 7 is again formed from a one-piece half-shell 56 and the side walls 48 and 49. The half-shell 56, formed from plastic, thus acts as the lever surface 57, so that the user now no longer has to grasp the metallic surface directly, but obtains a non-slip, safer and above all more comfortable grip. For this reason, the half-shell 56 has an angled extension 58 in its end region which covers the lever 7. In this manner, the gap between the two side walls 48, 49 is covered and the stability is increased. Furthermore, at the end region of the opposite side, the half-shell 56 is provided with an axle housing 59 which has an opening to accommodate the pivot 6. The axle housing 59 thus acts as a plastic disk, in particular as a washer, so that any annoying noises which might be made during an embossing procedure are prevented. Such annoying noises often come about when metals rub together; they are avoided in this manner. The one-piece construction also substantially reduces assembly costs In addition, the lever 7 is provided with a special lever shape 60 whereby it is deformed downwards in the direction of the base unit 2, i.e. it has a kink. This means that in the rest position 41, the lever 7 is closer to the base unit 2 and thus the handspan is reduced.

To match the special lever shape 60, the base unit 2 is constructed in a corresponding manner so that in the embossing position 42 the lever protrudes as far as possible out of the base unit 2 in order to provide for an optimal gripping position. This is accomplished by providing the base unit 2 with a special chamfered edge 61, which matches the shape of the lever 60, in particular the kink, i.e. on the base unit 2, in particular the side walls 50, 51, the chamfered edge 61 is formed in the upper region, which makes the upper edge of the side walls 50, 51 fall away more steeply so that as large a gripping surface for the lever 7 as possible is available beyond the base unit 2. This chamfered edge 61 has a further advantage, in that in this manner, injury to the user is prevented since none of the side walls 50, 51 project over the lever 7, in particular the lever surface 57.

A further essential embodiment of the embossing stamp 1 of the invention lies in the arrangement of the retaining device 3 for the die plate holder 5. This is now inclined with respect to the footprint area 44, i.e. the lower retaining plane 62 is formed at an angle to the footprint area 44, whereas an upper retaining plane 63 is orientated parallel to the footprint area 44. In this manner, the die plate holder 5 is inclined or at an angle to the base unit 2 when the embossing stamp 1 is placed on a surface. This has the advantage that when the embossing stamp 1 is lifted up, the user automatically matches this angle to feed in a document so that they can in fact feed in a document, whereupon the gripping position for the embossing procedure is optimized, and thus the user can apply the most force. Furthermore, the angled arrangement means that the embossing stamp 1 is shorter in length.

Furthermore, the retaining device 3 is constructed such that the lower retaining plane 62 is longer than the upper retaining plane 63, i.e. the lower retaining plane 62 protrudes beyond the upper retaining plane 63, so that a larger placement surface is created for the die plate holder 5 on the lower retaining plane 62. In particular, this means that in the front region, a pressure point is produced for the embossing procedure, so that over the whole surface an even relief image is produced. So that the die plate holder 5 is always inserted the same way into the retaining device 5, a positioning means 64, preferably in the form of a depression 65 or notch, is disposed on the lower retaining plane 62. Thus, the positioning means 64 act as a retaining element so that the die plate holder 5 cannot slide out of the retaining device all by itself because of the angled positioning.

In order to be able to carry out an embossing procedure in a manner which protects the die plate holder 5, in the inventive embodiment, a pressure element 66 is disposed on the lever 7, in particular between the side walls 48, 49, in the region where it contacts the die plate holder 5. The pressure element 66 is, for example, formed by a pressure roller 67 formed from a metal or low abrasion material and a pressure axle 68 formed from a metal or high-strength substance. In this manner, during an embossing procedure, the pressure roller 67 glides on the surface of the die plate holder 5 and thus minimizes frictional resistance and at the same time prevents damage to the surface.

As already described for the embodiments of FIGS. 1 to 3, this embodiment also has a locking lever 30, which is formed from a plastic cover 69 and an axle 70. In this manner, again the embossing stamp 1 can be fixed in the embossing position 42 when the user pushes the locking lever 30 into the locking position. This is made possible since appropriate recesses 71, 72 are provided in the base unit 2 and the lever 7 so that horizontal displacement of the lever 7 is possible. In particular, the recess 72 in the lever 7 has a special L-shape, whereas the recess 71 is horizontal. The lever 7 in the embodiment shown is thus preferably operated from both sides so that it can be pushed horizontally using two digits, in particular the thumb and index finger.

What is essential in the construction of the locking lever 30 is that the lock, in particular the locking lever 30, simultaneously acts as the stop for the levering movement of the lever 7. This is achieved by disposing the axle 70 of the locking lever 30 in the specially shaped recess 72, which is formed by an approximately horizontal guide recess 72*a* and an approximately vertical locking recess 72, so that the locking lever 30, in particular the axle 70, limits the movement of the lever upwards and downwards by means of the guide recess 72*a*. If, however, the lever 7 is moved downwards, i.e. into the embossing position 42, and impinges against the axle 70 at the end of the guide recess 72*a*, then the locking lever 30, in particular the axle 70, can still be pushed along the locking recess 72*b*, which is in particular horizontal, i.e. in the embossing position 42, the locking lever 30, in particular the axle 70, can be pushed into the locking recess 72*b*. In this manner, the lever 7 can no longer swing back into the start position, also termed the rest position 42 since vertical movement is prevented. This is only possible once more when the locking lever 30 is once again pushed with the axle 70 in the opposite direction, i.e. to the guide recess 72*a*, so that the lever 7 can be moved along the approximately horizontally orientated guide recess 72*a*. It can thus be stated that the locking lever 30, in particular the axle 70 running through the lever 7, is permanently engaged with the lever 7 and is pivotable in a limited manner along a guide track, in particular the guide recess 72*a*, constituting the levering movement. Thus, movement of the lever is limited in both directions by the lock, in particular the locking lever 30.

Figure 16:
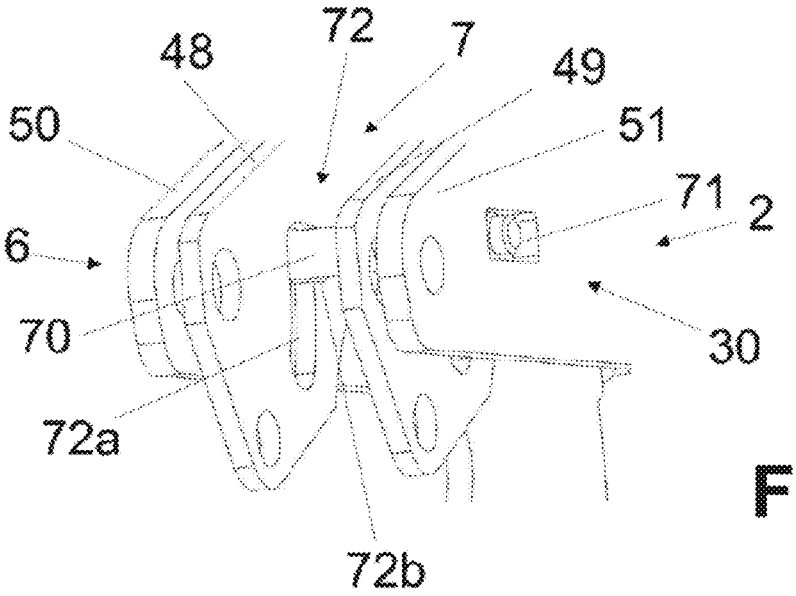
FIG. 16 is a detail of the embossing stamp showing the function of a locking lever which can be operated from both sides and to form a stop for a lever.

Clearly, it is also possible for the stop to limit the levering movement of the lever independently of the lock, whereby an axle or a stop rod extends in or through an approximately horizontal recess on the lever 7 which is mounted in the base unit. In this manner, the lever 7 can be moved upwards or downwards until the axle strikes the end of the recess. At the same time, as known in the prior art, the lock, in particular the locking lever 30, can be disposed beyond the lever 7 and only engage in an appropriate indentation of the lever 7 for locking when in the locking position. This thus means that in the exemplary embodiment of the invention, the levering movement of the lever 7 is limited by a stop which is preferably formed by the locking lever 30 or an axle or stop rod in combination with a recess on the lever 7, as is diagrammatically shown in the partial sectional view of the plier seal 1 in FIG. 16.

In general, it should be mentioned that for the purposes of weight reduction, the side walls 48 to 51 have recesses 73 the arrangement of which must ensure that the forces working on it can still be accommodated without distorting the embossing stamp 1 or the side walls 48 to 51. In this respect it is also possible to use additional reinforcing inserts in certain regions.

Figure 7:
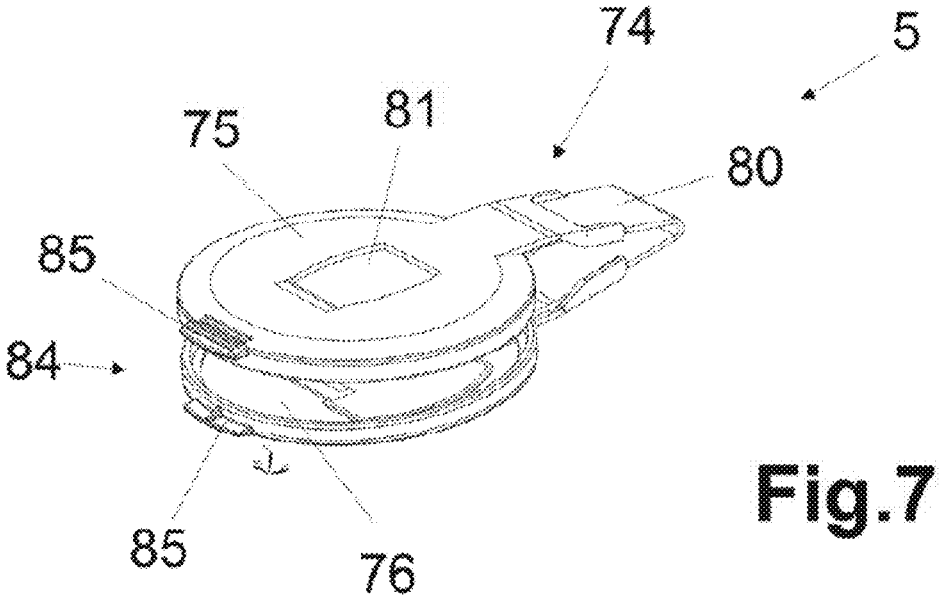
FIG. 7 is a top view of an ambient of a die plate holder, in a simplified diagrammatic view.
Figure 8:
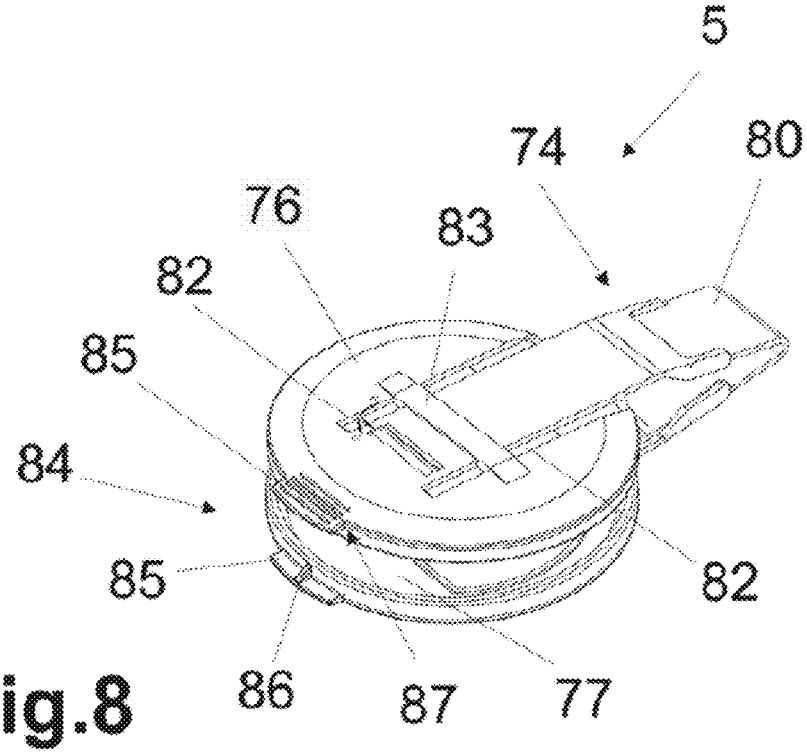
FIG. 8 is a bottom view of the embodiment of the die plate holder of FIG. 7, in a simplified diagrammatic view.
Figure 9:
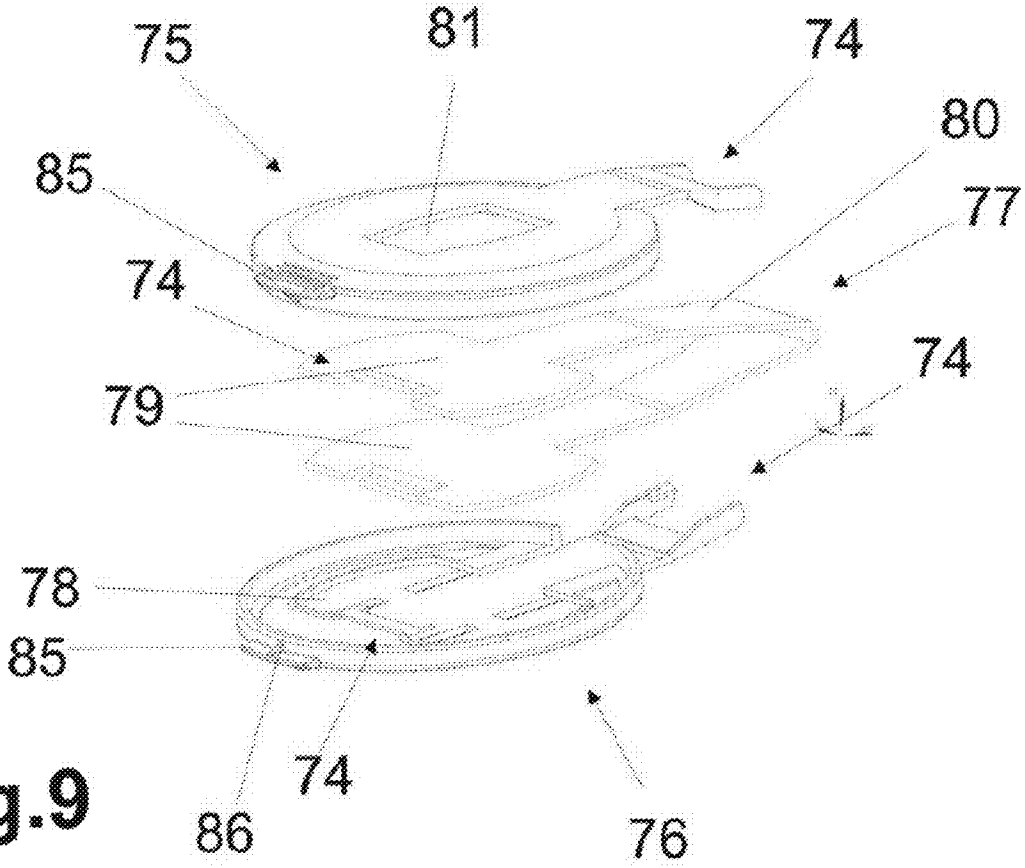
FIG. 9 is an exploded view of the embodiment of the die plate holder of FIG. 7 or FIG. 8, in a simplified diagrammatic view.

Turning now to FIGS. 7 to 9, the die plate holder 5 is shown in more detail. The die plate holder 5 in this embodiment is constructed as a hybrid component, like in the embodiment of FIGS. 4 to 12, i.e. part of the die plate holder 5 is formed from plastic and another part is formed from a resilient material which preferably, in a simple manner, can be put together without screw connections, for which purpose appropriate snap and/or click connections 74 are provided. Clearly, it is also possible to use this hybrid structure in the embossing stamp 1 shown in FIGS. 1 to 3 or in another embossing stamp of the prior art.

The hybrid structure is such that an embossing plate retainer 75, 76 is formed from plastic and a guide strip 77 is formed from resilient material, in particular metal. The embossing plate retainers 75, 76 are constructed as shells and are preferably in the shape of the die plates 37. In this regard, depressions 78 are provided, into which end regions 79 of the resilient guide strip 77 can be inserted. The end regions 79 are lamellar and are connected via a connecting web 80 which is shaped such that it has resilient properties, i.e. the connecting web 80 is angled so that both end regions 79 are at an appropriate distance apart. Preferably, the end regions 79 and the connecting web 80 are constructed in a one-piece manner from a resilient material. What is essential in the construction is that a width of the connecting web 80 is approximately as big as or smaller than separation of the panels of the side walls 50, 51, so that the connecting web 80 can be accommodated between the side walls 50, 51.

Because of the hybrid structure, it is advantageous for the upper embossing plate retainer 75 to have an opening 81 through which the pressure roller 67 of the lever protrudes and thus lies on the preferably metallic end region 79 of the guide strip 77. In this manner the friction, in particular frictional resistance, can be substantially reduced when the rolling movement when the lever 7 is moved occurs directly on a metallic material; a hybrid structure is possible because of this solution. This is of particular advantage when the metallic surface of the end region 79 is chrome-plated, along with the pressure roller 67, as this means that the frictional resistance is lowest.

Such an opening 81 is not required on the lower embossing plate retainer 76 as here, there is no rolling movement of an actuating element. The lower embossing plate retainer 76, on the other hand, has two guide slots 82 (see FIG. 8) which approximately correspond to the width of the thickness of the material of the side walls 50, 51, so that when the die plate holder 5 is inserted, it can be pushed in precisely via the guide slots 82. The arrangement of this guide slot 82 is again only possible because of the hybrid construction, since the embossing plate retainer 76 is produced as an injection moulded part and thus, such guide slots 82 can readily be formed.

As can be seen in FIG. 8, the lower embossing plate retainer 76 has a cross-link 83 which can be inserted in a depression or notch 65 on the side walls 50, 51, i.e. in this manner, exact and repeated identical positioning of the die plate carrier 5 is obtained since, when the die plate carrier 5 is pushed in, it snaps into the depressions 65 so that the user is made aware of pushing it over these depressions 65. In this respect, the recess and stop, in particular the depression 65, is displaced rearwardly so that guidance and positioning is as good as possible.

Furthermore, the die plate holder 5, in particular the two embossing plate retainers 75, 76, also have a special infeed opening 84. In this regard, an angled surface and/or a projection 85 with an angled guide web 86 or guide surface is disposed at the front region of the two embossing plate retainers 75, 76, which simulates a very wide infeed opening 84 or widely gaping embossing plate retainers 75, 76. This means that a wider insertion region is created for the document to be embossed, wherein because of the angled surface or the angled guide web 86, the document is deflected so that it is guided between the two embossing plates or die plates 37 positioned in the embossing plate retainers 75 76. This also means that it is possible for the border region of the embossing plate retainer 75, 76 to be correspondingly at an angle in order to facilitate feeding of the documents. At the same time, the outer surface of the projection 85 is grooved at 87 to provide a more secure grip. In this manner, the user can securely hold the die plate holder 5 by these projections 85 using two fingers and introduce it into the retaining device 3.

In the embodiment of the die plate holder 5 shown, the embossing plates or embossing stamp (not shown) are no longer pressed into the embossing plate retainers 75, 76, but the embossing plates or die plates 37 are glued into the embossing plate retainers 75, 76. For this purpose, a double-sided adhesive tape (not shown) is preferably used.

Since now the die plate carrier 5 can be positioned exactly over the depression 78, a positioning scale 88 is advantageously provided on the half-shell 43, in particular in the region below the retaining device 3. This can, for example, be a simple arrow, as shown, or indeed it may be a metric scale. This means that the user can set the position for embossing a document exactly. Clearly, it is possible to print or apply appropriate means for positioning on the embossing plate retainers 75, 76 as well, in particular an appropriate positioning scale 88, so that precise positioning can be carried out for the die plates 37.

Figure 10:
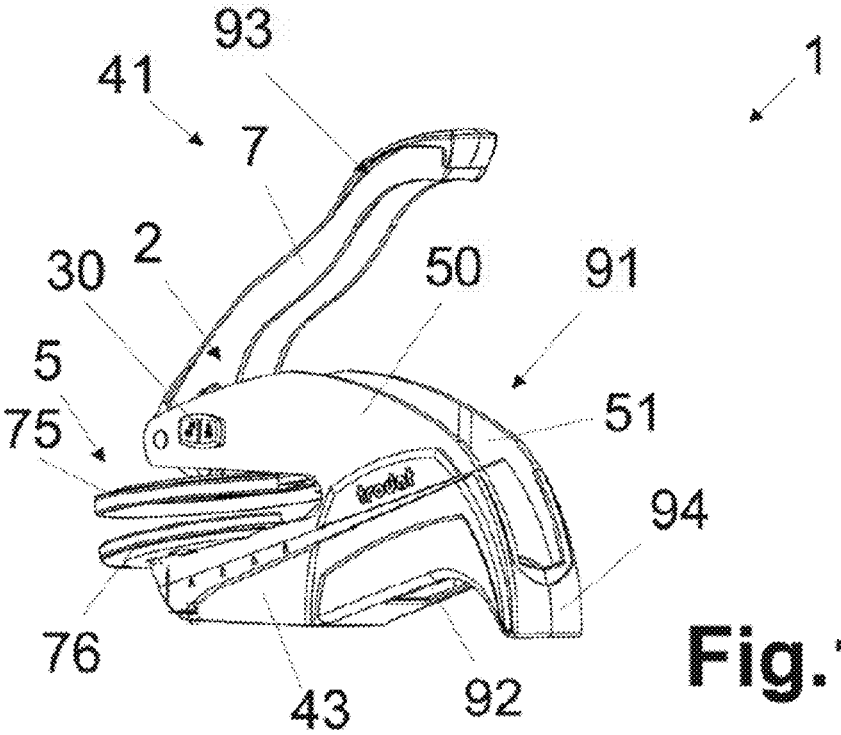
FIG. 10 is a back view of the embossing stamp of FIGS. 4 to 9, in a simplified diagrammatic view.
Figure 11:
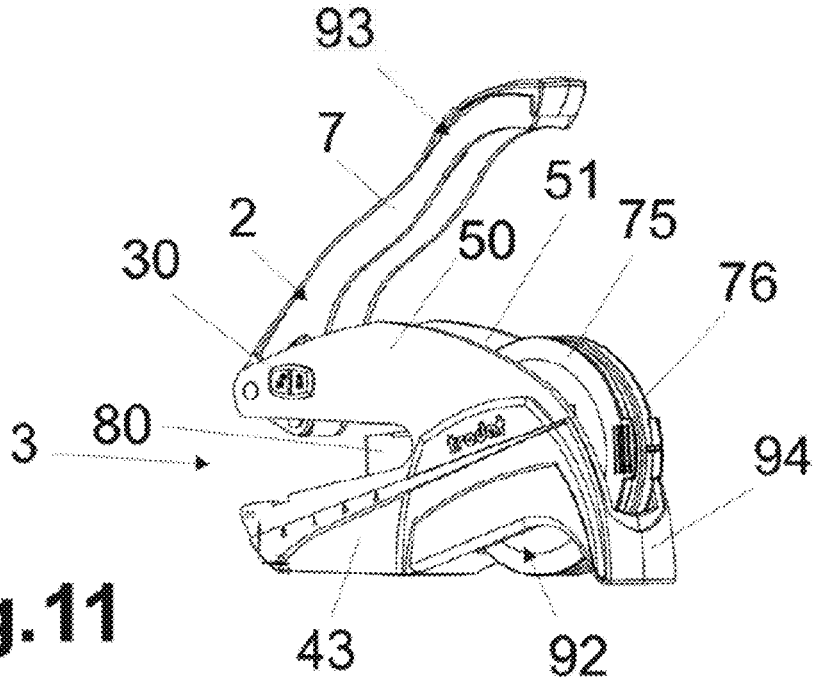
FIG. 11 is a further back view of the embossing stamp of FIGS. 4 to 10 with inserted die plate carrier in the rest position, in a simplified diagrammatic view.
Figure 12:
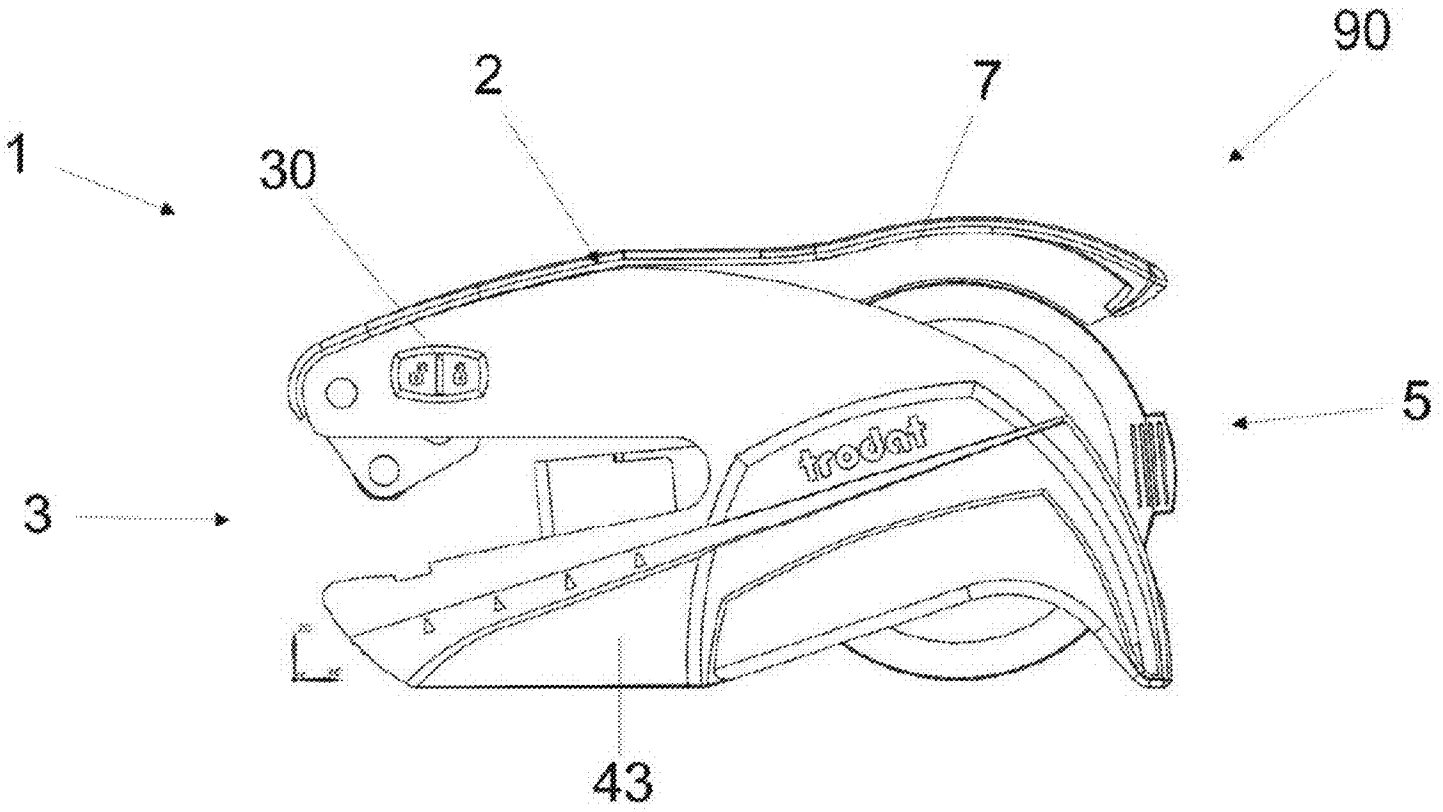
FIG. 12 is a side view of the embossing stamp of FIGS. 4 to 11 with inserted die plate carrier in the fixed operating position, in a simplified diagrammatic view.

Furthermore, in the embodiment shown in FIGS. 4 to 12, in particular FIGS. 10 to 12, a transport position 90 is shown in which the die plate carrier 5 is inserted into the base unit 2, i.e. the embossing stamp 1, in particular the base unit 2, is constructed so as to accommodate the die plate carrier 5. To this end, FIG. 10 shows the back view of the embossing stamp 1, in which a space 91 is provided between the side walls 50, 51. In addition, the half-shell 43 has an opening 92 in the region of the recessed grip 45, so that sufficient space is created for the embossing plate retainers 75, 76. The recessed grip 45 extends from the footprint area 44 into the base unit 2, so that the space 91 would be limited, but the opening 92 to accommodate the die plate holder 5 overcomes this.

The embossing stamp 1 here is in the rest position 41, so that the die plate holder 5 can be removed from the retaining device 3. Next, the die plate holder 5 is introduced from the back below the lever 7 into the space 91 so that the connecting web 80 is disposed in the region of the retaining device 3 and the embossing plate retainer 75, 76 are positioned through the opening 92 into the recessed grip 45, as can be seen in FIG. 11. In this manner, the die plate carrier 5 cannot fall out if the embossing stamp 1 is displaced or brought into the embossing position 42 and locked with the locking lever 30 so that moving backwards into the rest position 41 is prevented. In this regard, the lever 7 is provided with a retaining region 93 for the die plate holder 5, in particular the embossing plate retainer 75, 76 which, when the die plate holder 5 is inserted and when the lever 7 is fixed in the locking position 42, lies on the die plate holder 5 and keeps it from falling out of the base unit 2, i.e. the die plate holder 5 is prevented from falling out of the base unit 2 by the lever 7. In addition, it is possible for the half-shell 43 to be constructed such that it forms a back wall 94 which prevents anything from sliding out. In this manner, when inserting without fixing the lever 7, easy falling out or sliding out is instantly prevented, so that when the lever 7 is then fixed in the locking position 42, the die plate holder 5 is held.

Furthermore, the embossing stamp 1 in the embodiment shown in FIGS. 4 to 12 is constructed such that the recessed grip 45 is provided with appropriate indentations for the fingers (not shown), so that handling and a secure grip of the embossing stamp are ensured. A further embodiment is possible wherein the die plate holder 5, in particular the embossing plate retainers 38, 39, 75, 76 comprise positioning means to orientate the die plates 37, i.e., for example, notches, projections or printing are disposed on the side walls or the surface of the embossing plate retainers 38, 39, 75, 76 so that when the die plates 37 are inserted, they can be orientated as directed thereby. Here again, it is possible, for example, to provide a notch on the die plate 37 which corresponds to a projection or knob on the die plate holders 38, 39, 75, 76 so that this die plate 37 is always inserted the same way round.

Figure 13:
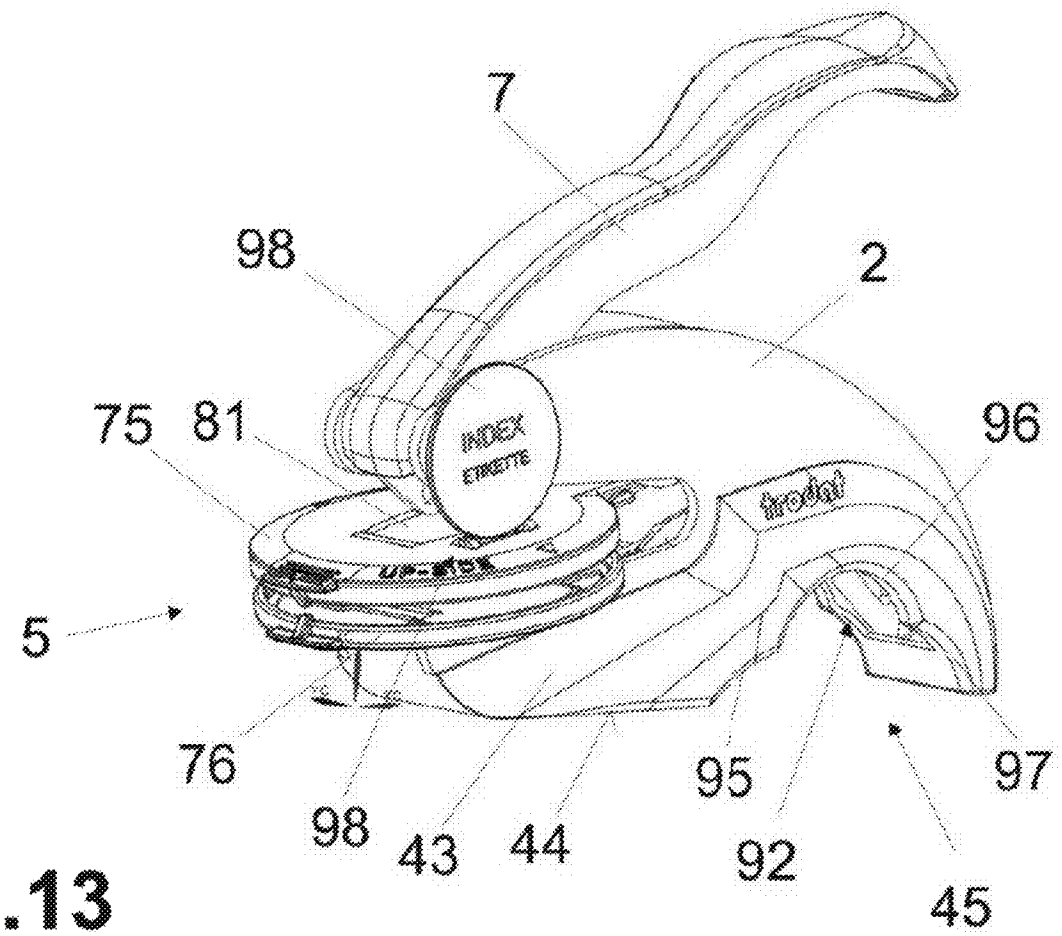
FIG. 13 is a perspective view of the embossing stamp with inserted die plate holder on which an index card is disposed.
Figure 14:
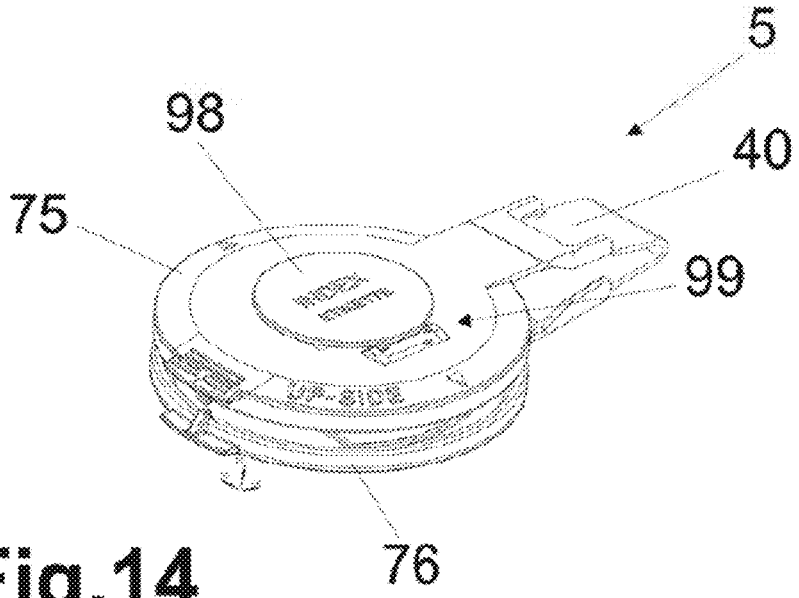
FIG. 14 is a perspective view of the die plate holder with applied index card.
Figure 15:
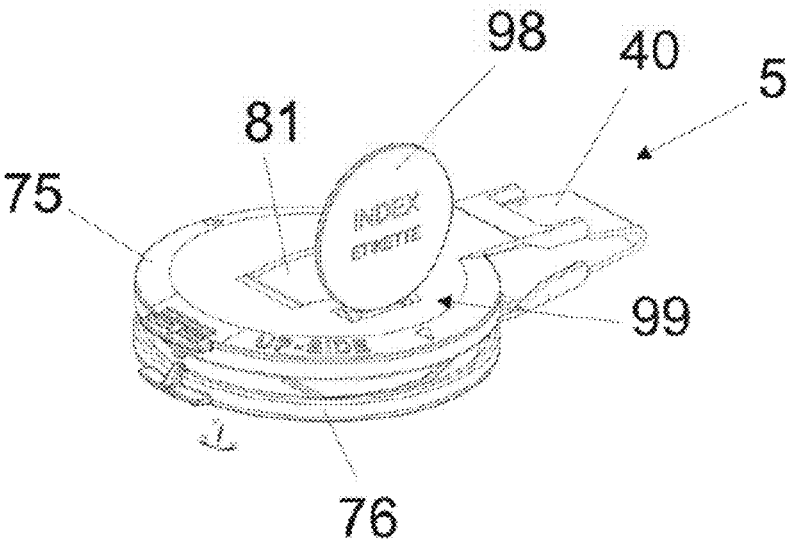
FIG. 15 is a further perspective view of the die plate holder of FIG. 14 with upright index card.

FIGS. 13 to 15 show a further embodiment with a different format or design for the lamellar embossing stamp 1. The difference between the variation shown in FIG. 13 and the figures described above, in particular the embodiments of FIGS. 4 to 12, is that now a special construction for the recessed grip 45 is provided in the region of the footprint area 44. Here, the recessed grip 45 is constructed such that circular sections 95-97, in particular three sections 95-97, are provided to accommodate the user's fingers, which extend into the base unit 2 in the direction of the lever 7. The section 96 disposed in the centre protrudes furthest into the base unit 2. However, because the die plate holder 5 can be accommodated in the base unit 2, the opening 92 is again provided in the region of the recessed grip 45 so that the embossing plate retainers 75, 76 can be inserted and protrude into the recessed grip 45.

Furthermore, a special inventive embodiment of the die plate holder 5 is shown in which now, an index card 98 is provided for the embossed impression and/or to identify the die plate holder 5, wherein a fastening means for the index card 98 is provided on the embossing plate holder 75. Here, the fastening means for the index card 98 is, for example, formed by a swivel-lock hinge 99 and is connected to the die plate holder 5, in particular the embossing plate retainer 75, as can best be seen in FIG. 14. By means of this arrangement of the swivel-lock hinge 99, the index card 98 can be pivoted onto the embossing plate retainer 75 when the die plate holder 5 has been removed, and in this position a first latching can be carried out. Here, the swivel-lock hinge 99 preferably covers the opening 81 of the embossing plate retainer 75.

If the die plate holder 5 with the index card 98 is inserted in the embossing stamp 1, then firstly the index card 98 is swung up into a preferable second snap connection so that it is disposed at an angle of approximately 90° to the surface of the embossing plate retainer 75, as can be seen in FIG. 15. At the same time, the opening 81 is cleared so that the pressure element 66 of the lever 7 can act on the metallic guide strip 77 through the opening 81. This positioning also means that now, the die plate holder 5 can again be pushed or inserted easily into the retaining device 3 of the embossing stamp 1. The position of the index card 98 when the die plate holder 5 is inserted is parallel to the lever 7, so that embossing can be carried out without hindrance.

Such an arrangement of an index card 98 means that the user can now easily identify the embossed impression or the embossing stamp 1, since it can be depicted on the index card 98, i.e. the index card copies the embossed impression or a particular identification is present, namely a label preferably with the embossed impression or an identifying image or number can be adhered thereto.

It is also possible here for the index card 98 to be formed from multiple parts so that, for example, a removable frame (not shown) is used, and thus the embossed impression or identification can be inserted. Further, instead of the swivel-lock hinge 99, the index card 98 could be constructed so as to be removable so that this on the one hand can be fixed in the opening 81 on the surface of the embossing plate retainer 75 (see FIG. 14) and on the other hand can be inserted into a further recess (not shown) so that the index card 98 can be positioned at an angle of approximately 90° to the surface of the embossing plate retainer 75 (see FIG. 15). It is also possible for the index card 98 to be smaller than the embossed impression, i.e. the die plates 37.

In a further embodiment, it is also possible for the index card 98 to be able to be removed from the die plate holder 5 and, for example, fastened to the lever 7 or embossing stamp 1. To this end, the lever 7, in particular the half-shell 56 of the lever 7, is provided with a recess in which the index card 98 can be fastened via a snap-fit pin, i.e. the user removes the index card 98 from the die plate holder 5 and simply sticks it on the lever 7 so that the image on the index card 98 is visible.

Figure 17:
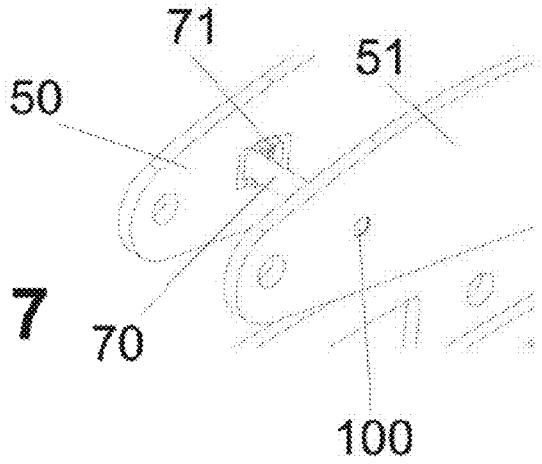
FIG. 17 is a further embodiment with a detail of a further function of a locking lever which can be operated from one side and to form a stop.
Figure 18:
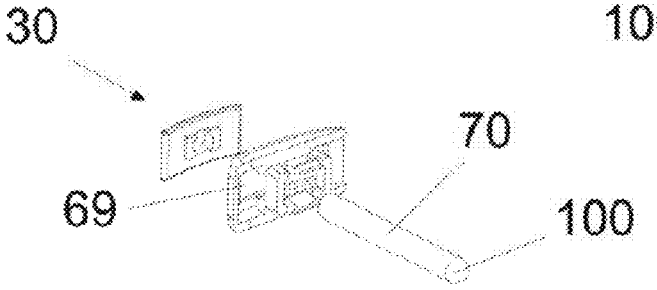
FIG. 18 is an exploded view of the locking lever of FIG. 17.
Figure 19:
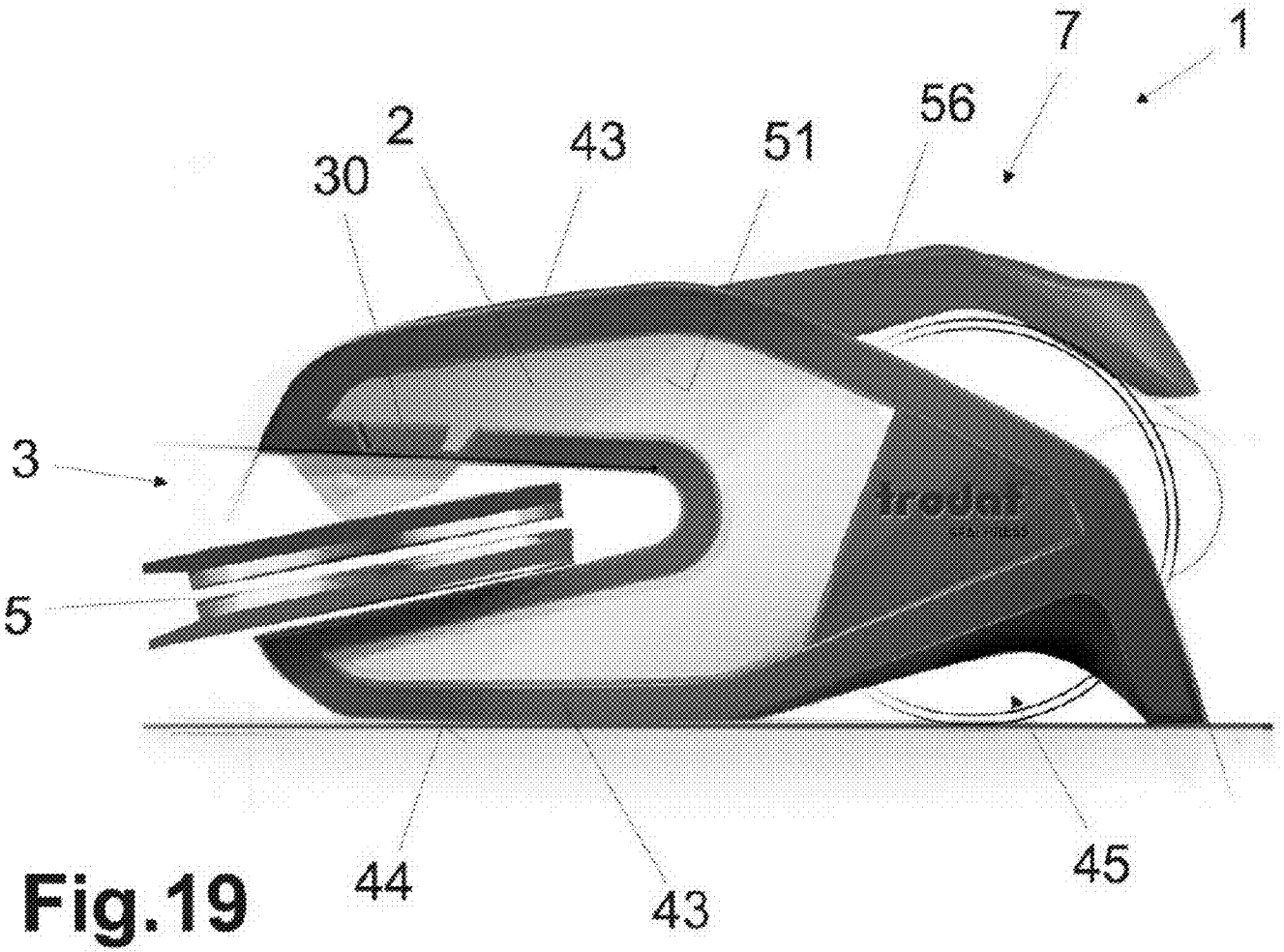
FIG. 19 is a further embodiment of the embossing stamp with a different construction for the half-shell, in a simplified diagrammatic view.
Figure 20:
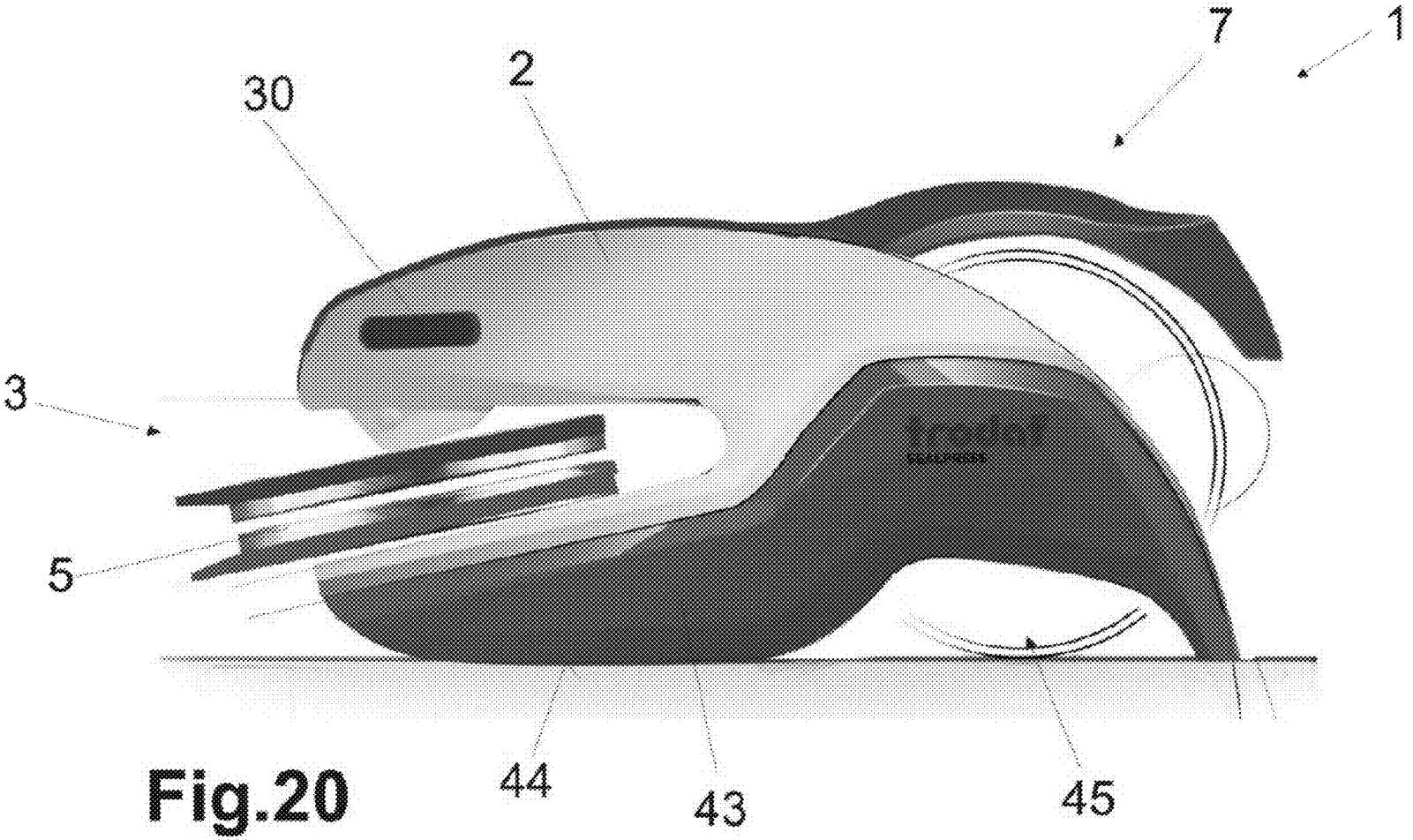
FIG. 20 is an embodiment of the embossing stamp with an enlarged recessed grip, in a simplified diagrammatic view.

Since, however, on one side the arrangement of the die plate holder 5 in the embossing stamp 1 is covered by the locking lever 30, for optimal functional locking, a different construction must be used, as can be seen in FIGS. 17 and 18, wherein the lever 7 with the recess 72 is not shown for the purposes of clarity. Single sided operation of the locking lever 30 described and shown above in FIGS. 4 to 13 might give rise to problems, as it could derail if a one-sided pushing motion is undertaken.

For this purpose, on the side opposite to the index card 98, the locking lever 30 is again formed by the cover 69 which is connected to the axle 70. The axle 70 again extends through the recess 71 in the base unit 2 into the recess 72 in the lever 7, but in this case on the opposite side, i.e. on the side with the index card 98, the axle 70 is hingeably mounted on one side on the base unit 2. To this end, the axle 70 has a rounded end region 100, as can be seen in FIG. 18. In this manner, on one side the axle 70 can now be pivotally mounted, and on the opposite side is approximately horizontally displaceable via the recess 71. In this manner, the levering movement of the lever 7 is again limited by a stop which preferably is formed by the locking lever 30 or an axle 70 or a stop rod in connection with the recess 72 on the lever 7; now, operation of the locking lever 30 is carried out from just one side.

A further embodiment is shown in FIG. 17. Here, the half-shell 43 is constructed such that it covers all of the edges of the base unit 2, in particular the panel elements 50, 51. In general here, it is possible for the half-shell to be constructed in several parts. Thus, a circumferential border is formed from plastic in which the metallic panel elements 50, 51 are inserted. Further, in the embodiment shown, the lever 7 is constructed such that the panel elements 48, 49 are completely integrated into the half-shell 56 or are moulded in during manufacture of the half-shell 56. It is also possible to stamp appropriate symbols, such as a locking symbol on the locking lever 30 and/or positioning scales 88 (not shown) on the panel elements 48 to 51, below the retaining device 3.

In an embodiment as shown in FIG. 18, it can be seen that the recessed grip 45 is now wider, and in particular projects deeper into the base unit 2. At the same time, the front region in the direction of the retaining device 3 is steeper, so that it acts as a stop for the user's fingers. As can be seen in this embodiment, the panel elements 48, 49 are completely integrated into the half-shell 56.

For the record, it should finally be noted that for better comprehension of the construction of the system 1 and its components or parts, in places the drawings are not to scale and/or have been enlarged and/or reduced in scale.

Further, individual features or combinations of features from the various described and illustrated embodiments form independent, inventive solutions or solutions in accordance with the invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A die plate holder for an embossing stamp, comprising at least an upper and a lower embossing plate retainer having opposing inner facing surfaces arranged in spaced apart relationship forming an opening therebetween, the upper and the lower embossing plate retainer connected together via a guide strip extending within the opening, the guide strip including end regions attached to the inner facing surfaces of the upper and lower embossing plate retainers and a resilient web connecting the end regions in spaced apart relationship;

wherein the die plate holder is constructed as a hybrid structure in which the embossing plate retainer is formed from plastic and the guide strip is formed from a resilient material or plastic, in particular a high performance plastic with resilient and abrasion-resistant properties, wherein the upper and lower embossing plate retainers are constructed as a shell having a depression receiving the end regions of the guide strip for attaching the guide strip to the upper and lower embossing plate retainers.

2. The die plate holder for an embossing stamp as claimed in claim 1, wherein the embossing plate retainers have a front region, and wherein an angled surface and/or a projection with an angled guide web or guide surface is disposed at least at the front region or circumferentially of the embossing plate retainers to form an enlarged infeed opening provided between the embossing plate retainers.

3. The die plate holder for an embossing stamp as claimed in claim 1, wherein a embossing plate retainer, in particular the lower, comprises guide slots and preferably a cross-link for guiding and fixing an embossing stamp.

4. The die plate holder for an embossing stamp as claimed in claim 1, wherein the die plate holder is formed from a high performance plastic, wherein a metallic insert for an action of a lever of the embossing stamp is disposed on the upper embossing plate retainer.

5. The die plate holder for an embossing stamp as claimed in claim 1, wherein the embossing plate retainer comprises positioning means to align die plates.

6. The die plate holder for an embossing stamp as claimed in claim 1, wherein a ring element with angled guide webs or guide surfaces can be attached to the embossing plate retainers to form an enlarged infeed opening therebetween on the embossing plate retainers.

7. The die plate holder for an embossing stamp as claimed in claim 1, wherein an index card for the embossed impression and/or to identify the die plate is disposed on or removable from an embossing plate retainer.

8. The die plate holder for an embossing stamp as claimed in claim 7, wherein the embossing plate holder has a fastening means for the index card.

9. The die plate holder for an embossing stamp as claimed in claim 8, wherein the fastening means for the index card is formed by a swivel-lock hinge.

10. The die plate holder for an embossing stamp as claimed in claim 1, wherein the guide strip is metal.

11. The die plate holder for an embossing stamp as claimed in claim 10, further including another opening within the upper embossing plate retainer exposing the guide strip therein.

12. A die plate holder for an embossing stamp having a lever, comprising at least an upper and a lower embossing plate retainer having opposing inner facing surfaces arranged in spaced apart relationship forming an opening therebetween, the upper and the lower embossing plate retainer connected together via a guide strip, wherein the die plate holder is constructed as a hybrid structure in which the embossing plate retainers are formed from a first resilient material and the guide strip is formed from a second resilient material different from the first resilient material, wherein the die plate holder is formed from a high performance plastic, wherein a metallic insert for an action of the lever of the embossing stamp is preferably disposed on the upper embossing plate retainer.

13. The die plate holder for an embossing stamp as claimed in claim 12, wherein the guide strip is metal.

14. The die plate holder for an embossing stamp as claimed in claim 13, further including another opening within the upper embossing plate retainer exposing the guide strip therein.

15. A die plate holder for an embossing stamp having a lever, comprising at least an upper and a lower embossing plate retainer having opposing inner facing surfaces arranged in spaced apart relationship forming an opening therebetween, the upper and the lower embossing plate retainer connected together via a guide strip extending within the opening; wherein the die plate holder is constructed as a hybrid structure in which the embossing plate retainer is formed from plastic and the guide strip is formed from a resilient material or plastic, in particular a high performance plastic with resilient and abrasion-resistant properties, wherein the die plate holder is formed from a high performance plastic, and wherein a metallic insert for an action of the lever of the embossing stamp is disposed on the upper embossing plate retainer.

16. A die plate holder for an embossing stamp, comprising at least an upper and a lower embossing plate retainer having opposing inner facing surfaces arranged in spaced apart relationship forming an opening therebetween, the upper and the lower embossing plate retainer connected together via a metal guide strip extending within the opening; wherein the die plate holder is constructed as a hybrid structure in which the embossing plate retainer is formed from plastic and the guide strip is formed from a resilient material or plastic, in particular a high performance plastic with resilient and abrasion-resistant properties, and further including another opening within the upper embossing plate retainer exposing the guide strip therein.

17. A die plate holder for an embossing stamp, comprising at least an upper and a lower embossing plate retainer having opposing inner facing surfaces arranged in spaced apart relationship forming an opening therebetween, the upper and the lower embossing plate retainer connected together via a metal guide strip, wherein the die plate holder is constructed as a hybrid structure in which the embossing plate retainers are formed from a first resilient material and the guide strip is formed from a second resilient material different from the first resilient material, further including another opening within the upper embossing plate retainer exposing the guide strip therein.

* * * * *